US006604651B2

(12) United States Patent
Amundson et al.

(10) Patent No.: US 6,604,651 B2
(45) Date of Patent: Aug. 12, 2003

(54) STORAGE AND DISPENSING PACKAGE FOR WIPES

(75) Inventors: John David Amundson, Crawley (GB); Dennis Edward Fryer, Ashford (GB); Peter Booth, Marlborough (GB); Martin Christopher Bunce, Marlborough (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 70 days.

(21) Appl. No.: 09/813,536

(22) Filed: Mar. 21, 2001

(65) Prior Publication Data

US 2002/0096534 A1 Jul. 25, 2002

Related U.S. Application Data

(63) Continuation-in-part of application No. 09/769,184, filed on Jan. 24, 2001.

(51) Int. Cl.[7] ..... A47K 10/24

(52) U.S. Cl. ..... 221/47; 221/48; 221/63; 221/64; 221/97; 206/233

(58) Field of Search ..... 221/47, 48, 63, 221/64, 97; 206/233

(56) References Cited

U.S. PATENT DOCUMENTS

| | | | | |
|---|---|---|---|---|
| 2,004,614 A | | 6/1935 | Meagher | |
| 3,095,991 A | | 7/1963 | Paniagua | |
| 3,207,360 A | * | 9/1965 | Scott | 221/48 |
| 3,266,665 A | * | 8/1966 | Eakens | 221/48 |
| 3,266,666 A | * | 8/1966 | Nelson | 221/48 |
| 3,401,928 A | | 9/1968 | Frick | |
| 3,462,043 A | | 8/1969 | Frick | |
| 3,473,694 A | * | 10/1969 | Murphy et al. | 221/63 |
| 3,749,296 A | | 7/1973 | Harrison | |
| 3,780,908 A | | 12/1973 | Fitzpatrick et al. | |

(List continued on next page.)

FOREIGN PATENT DOCUMENTS

| | | |
|---|---|---|
| DE | 297 05 157 U1 | 11/1997 |
| EP | 0 096 546 B1 | 5/1987 |
| EP | 0 068 722 B1 | 4/1988 |
| EP | 0 302 382 A1 | 2/1989 |
| EP | 0 286 538 B1 | 1/1992 |

(List continued on next page.)

OTHER PUBLICATIONS

Patent Cooperation Treaty Search Report from the International Search Authority, International Application No. PCT/US 02/02101 dated Jan. 23, 2002.

Product bag sold by Kimberly–Clark Corporation under the tradename HUGGIES® Supreme Care Baby Wipes, commercially available at least as early as Jan. 23, 2001.

American Society for Testing Materials (ASTM) Designation: D 412–98a "Standard Test Methods for Vulcanized Rubber and Thermoplastic Elastomers—Tension[1]" pp. 43–55, published Aug. 1998.

(List continued on next page.)

*Primary Examiner*—Christopher P. Ellis
*Assistant Examiner*—Rashmi Sharma
(74) *Attorney, Agent, or Firm*—Michael J. Bendel

(57) ABSTRACT

A storage and dispensing package for wipes comprising a non-rigid container having sides which define a cavity. A collapsible-expandable baffle structure having a width is positioned within the sides of the container and divides the cavity into a storage portion for wipes and a dispensing portion. The baffle structure includes a dispensing orifice through which wipes can pass and communicate with the dispensing portion. A resealable mechanism can also be included at an end of the package.

60 Claims, 29 Drawing Sheets

U.S. PATENT DOCUMENTS

| | | | | | |
|---|---|---|---|---|---|
| 3,836,044 | A | | 9/1974 | Tilp et al. | |
| 3,841,466 | A | | 10/1974 | Hoffman et al. | |
| 3,868,052 | A | | 2/1975 | Rockefeller | |
| 3,986,479 | A | | 10/1976 | Bonk | |
| 3,994,417 | A | | 11/1976 | Boedecker | |
| 4,002,264 | A | * | 1/1977 | Marchesani | 221/63 |
| 4,004,687 | A | | 1/1977 | Boone | |
| 4,017,002 | A | | 4/1977 | Doyle et al. | |
| 4,100,324 | A | | 7/1978 | Anderson et al. | |
| 4,131,195 | A | | 12/1978 | Worrell, Sr. | |
| 4,133,457 | A | | 1/1979 | Klassen | |
| 4,138,034 | A | | 2/1979 | McCarthy | |
| 4,180,160 | A | | 12/1979 | Ogawa et al. | |
| 4,185,754 | A | | 1/1980 | Julius | |
| 4,191,230 | A | | 3/1980 | Ausnit | |
| 4,252,238 | A | | 2/1981 | Spiegelberg et al. | |
| 4,285,376 | A | | 8/1981 | Ausnit | |
| 4,289,262 | A | | 9/1981 | Finkelstein | |
| D263,283 | S | | 3/1982 | Ronayne | |
| 4,337,876 | A | | 7/1982 | Thompson | |
| 4,478,354 | A | * | 10/1984 | Notheis | 221/34 |
| 4,535,912 | A | * | 8/1985 | Bonk | 221/46 |
| 4,540,091 | A | * | 9/1985 | Habock | 206/494 |
| 4,550,855 | A | | 11/1985 | Harrison | |
| 4,562,938 | A | * | 1/1986 | Loder | 221/46 |
| 4,570,820 | A | * | 2/1986 | Murphy | 221/34 |
| 4,610,357 | A | | 9/1986 | Nakamura | 206/449 |
| 4,637,061 | A | | 1/1987 | Riese | |
| 4,638,921 | A | * | 1/1987 | Sigl et al. | 221/1 |
| 4,678,099 | A | * | 7/1987 | Matsui | 221/48 |
| D296,765 | S | | 7/1988 | Urion | |
| 4,784,290 | A | | 11/1988 | Howard | |
| 4,848,575 | A | | 7/1989 | Nakamura et al. | |
| 4,863,064 | A | * | 9/1989 | Dailey, III | 221/48 |
| 4,925,316 | A | | 5/1990 | Van Erden et al. | 383/61 |
| 4,934,535 | A | * | 6/1990 | Muckenfuhs et al. | 206/610 |
| 5,135,134 | A | * | 8/1992 | Dancy | 221/61 |
| 5,145,091 | A | | 9/1992 | Meyers | |
| 5,285,927 | A | * | 2/1994 | Pruitt | 221/22 |
| 5,368,188 | A | | 11/1994 | Twardowski | |
| 5,458,259 | A | * | 10/1995 | Falk | 221/22 |
| 5,497,903 | A | | 3/1996 | Yoneyama | |
| 5,542,567 | A | | 8/1996 | Julius | |
| 5,542,568 | A | | 8/1996 | Julius | |
| 5,582,294 | A | | 12/1996 | Yamada | |
| 5,601,368 | A | | 2/1997 | Bodolay et al. | |
| 5,685,643 | A | * | 11/1997 | Stary | 383/24 |
| 5,704,471 | A | | 1/1998 | Yamada | |
| 5,729,955 | A | | 3/1998 | Yamada | |
| 5,755,356 | A | * | 5/1998 | Bastiaens et al. | 221/33 |
| D395,952 | S | | 7/1998 | Buczwinski et al. | |
| 5,785,179 | A | | 7/1998 | Buczwinski et al. | |
| D397,938 | S | | 9/1998 | Graham et al. | |
| 5,908,138 | A | | 6/1999 | Vlahakis et al. | |
| D412,439 | S | | 8/1999 | Cormack | |
| 5,938,013 | A | | 8/1999 | Palumbo et al. | |
| D414,637 | S | | 10/1999 | Amundson et al. | |
| 6,053,357 | A | * | 4/2000 | Yoh | 221/63 |
| 6,079,878 | A | | 6/2000 | Yeager | |
| D430,455 | S | | 9/2000 | Pickens | |
| 6,152,322 | A | | 11/2000 | Marino | |
| 6,164,442 | A | | 12/2000 | Stravitz | |
| 6,182,858 | B1 | | 2/2001 | Hartog | |

FOREIGN PATENT DOCUMENTS

| | | |
|---|---|---|
| EP | 0 331 027 B1 | 1/1992 |
| EP | 0 410 937 B1 | 12/1993 |
| EP | 0 699 163 B1 | 1/1997 |
| EP | 0 644 130 B1 | 5/1998 |
| EP | 0 747 313 B1 | 5/1998 |
| EP | 0 980 841 A2 | 2/2000 |
| EP | 0 983 739 A2 | 3/2000 |
| EP | 0 983 740 A2 | 3/2000 |
| EP | 0 744 357 B1 | 10/2000 |
| EP | 0 900 043 B1 | 11/2000 |
| GB | 2 106 862 B | 4/1985 |
| WO | WO 98/06640 A1 | 2/1998 |
| WO | WO 98/29018 A1 | 7/1998 |

OTHER PUBLICATIONS

American Society for Testing Materials (ASTM) Designation: D 790–99 "Standard Test Methods for Flexural Properties of Unreinforced and Reinforced Plastics and Electrical Insulating Materials[1]" pp. 150–158, published Feb. 2000.

American Society for Testing Materials (ASTM) Designation: D 2240–97[e1] "Standard Test Method for Rubber Property—Durometer Hardness[1]" pp. 400–403, published Mar. 1997.

American Society for Testing Materials (ASTM) Designation: D 6125–97 "Standard Test Method for Bending Resistance of Paper and Paperboard (Gurley Type Tester)[1]" pp. 885–889, published Feb. 1998.

* cited by examiner

STORAGE AND DISPENSING PACKAGE FOR WIPES

RELATED APPLICATIONS

This application is a continuation-in-part of application Ser. No. 09/769,184 entitled STORAGE AND DISPENSING PACKAGE FOR WIPES and filed in the U.S. Patent and Trademark Office on Jan. 24, 2001. The entirety of application Ser. No. 09/769,184 is hereby incorporated by reference.

BACKGROUND OF THE INVENTION

Wipes have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has bee n arranged in a folded configuration such as a c-folded, z-folded or quarter-folded configuration as are well known to those skilled in the art. Sometimes the folded wet wipes have also been interfolded with the wet wipes immediately above and below in the stack of wet wipes. In an alternative configuration, the wet wipes have been placed in the container in the form of a continuous web of material which includes perforations to separate the individual wet wipes and which is wound into a roll. Such wet wipes have been used for baby wipes, hand wipes, household cleaning wipes, industrial wipes and the like.

The conventional packages which contain wipes, such as those described above, have typically been designed to be positioned on a flat surface such as a counter top, changing table or the like. Such conventional packages have generally provided a plastic container, tub or package which provides a sealed environment for the wet wipes to ensure that they do not become overly dry. Some of the conventional packages have also been configured to provide one at a time dispensing of each wet wipe which can be accomplished using a single hand after the package has been opened. Such single handed, one at a time dispensing is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a baby wipe to clean the infant.

However, the dispensing of wipes from such conventional containers for wipes has not been completely satisfactory. For example, many conventional containers are not capable of partially dispensing a wipe, holding a top portion of the wipe accessible and in place for the next dispensing, and also maintaining the top portion of the wipe in a hygienic, sealable environment. As another example, conventional containers are not capable of readily retaining the top portion of the wipe in the hygienic, sealable environment merely as a part of the dispensing step without more. As yet another example, conventional containers are not compact and easy to transport while also being reliable and easy to store and dispense wipes in a same package container.

SUMMARY OF THE INVENTION

In response to the difficulties and problems discussed above, for example, a new package for wipes that has improved storage and dispensing, has improved hygienic ability and moisture retention and/or has improved compactness and reliability, has been discovered. The purposes and features of the present invention will be set forth in and are apparent from the description that follows, as well as will be learned by practice of the invention. Additional features of the invention will be realized and attained by the packages particularly pointed out in the written description and claims hereof, as well as from the appended drawings.

In one aspect, the invention provides a storage and dispensing package for wipes, e.g., wet wipes. The package can include a non-rigid container having sides which define a cavity therein. A collapsible-expandable baffle structure having a width is positioned within the sides of the container and divides the cavity into a storage portion for wipes and a dispensing portion. The baffle structure includes a dispensing orifice through which wipes can pass and communicate with the dispensing portion.

In another aspect, the invention also provides a storage and dispensing package for wipes. The package can include a non-rigid container having sides with a top end portion and a bottom end portion, where the sides and top and bottom end portions define a cavity within the container. The cavity includes a storage portion for wipes. The top end portion includes a resealable mechanism. A non-rigid baffle structure having a width is located in between the resealable mechanism and the storage portion with the baffle structure positioned between opposing sides of the container spaced apart from each other. In this way, the baffle structure defines a dispensing portion of the cavity overlying the storage portion of the cavity. The baffle structure includes a dispensing orifice through which wipes can pass and communicate with the dispensing portion.

In other aspects, the invention provides various baffle structure configurations and orientations. For example, configurations such as partially spanning the space between the sides of the container to completely spanning that space, separate piece and same piece construction with the container, baffle structure width, the baffle structure relative to wipes in the container, and, orientations such as parallel to wipes included therein.

In yet other aspects, the invention provides a dispensing orifice having particular characteristics such as type of seal, condition of the seal, and configurations and orientations of the orifice.

As with the other packages of the invention, the container and baffle structure can be transparent or translucent to provide an indication of the quantity of wipes remaining in the package. The container and baffle structure can be made of various polymers, copolymers, and mixtures. including, e.g., polyethylene, polypropylene, polyester, polystyrene, and other polymers.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the packages of the invention. Together with the description, the drawings serve to explain the various aspects of the invention.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts of the packages depicted in the drawings are referred to by the same reference numerals.

DETAILED DESCRIPTION OF THE INVENTION

Figure 1:
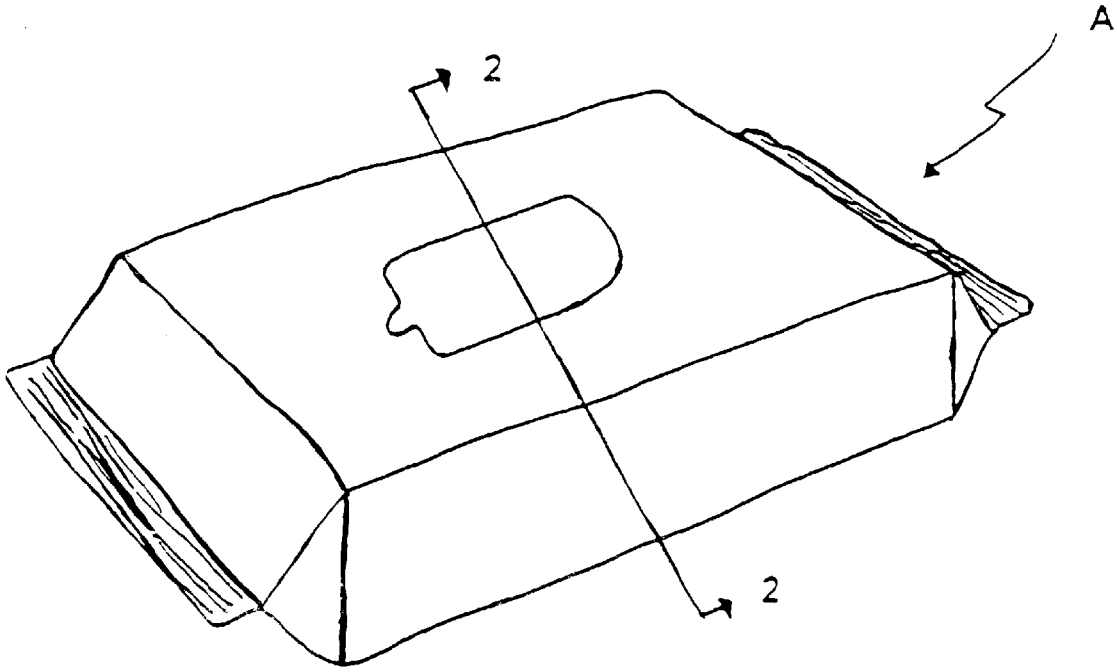
Figure 1 (prior art)
FIG. 1 representatively shows a perspective view of a conventional film wrapped container for wet wipes, with a resealable label.
Figure 2:
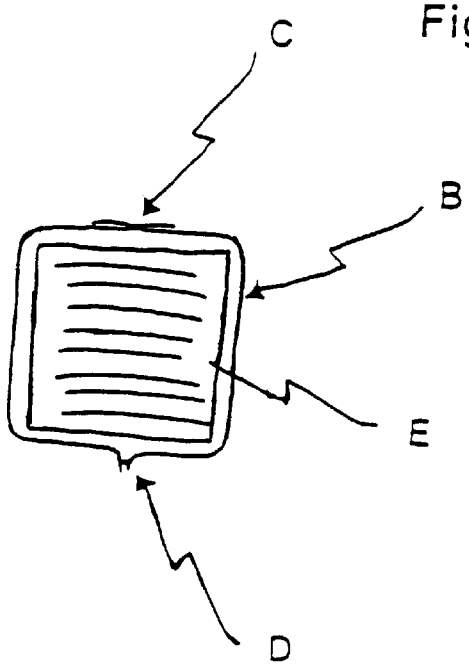
Figure 2 (prior art)
FIG. 2 representatively shows a cross-sectional view of the container for wet wipes illustrated in FIG. 1, taken along the line 2—2.

The present invention is directed at solving problems related to containers for wipes, e.g., wet wipes. An example of a conventional non-rigid container is seen in FIGS. 1 and 2 of the drawings appended hereto. In FIG. 1 is seen a conventional film wrapped container A for wet wipes. FIG. 2 shows a cross-sectional view of the container A for wet wipes. Container A includes a flow wrap film B which encloses wet wipes E and is sealed closed along the bottom by end seal D. A resealable label C is attached by a resealable adhesive around its periphery surface adjacent the film B.

As representatively illustrated throughout the FIGS. 3–36, and for explanation now in FIGS. 3–10, the present invention provides a storing and dispensing package 20 for wipes 120. The package 20 includes a non-rigid container 30 having sides 50 with a top end portion 52 and a bottom end portion 54, where the sides and top and bottom end portions define a cavity 56 within the container 30. As used herein, "non-rigid" means a non-foamed polymeric containing film with a thickness of about 250 micrometers or less or a foamed polymeric containing film with a thickness of about 2000 micrometers or less.

Figure 3:
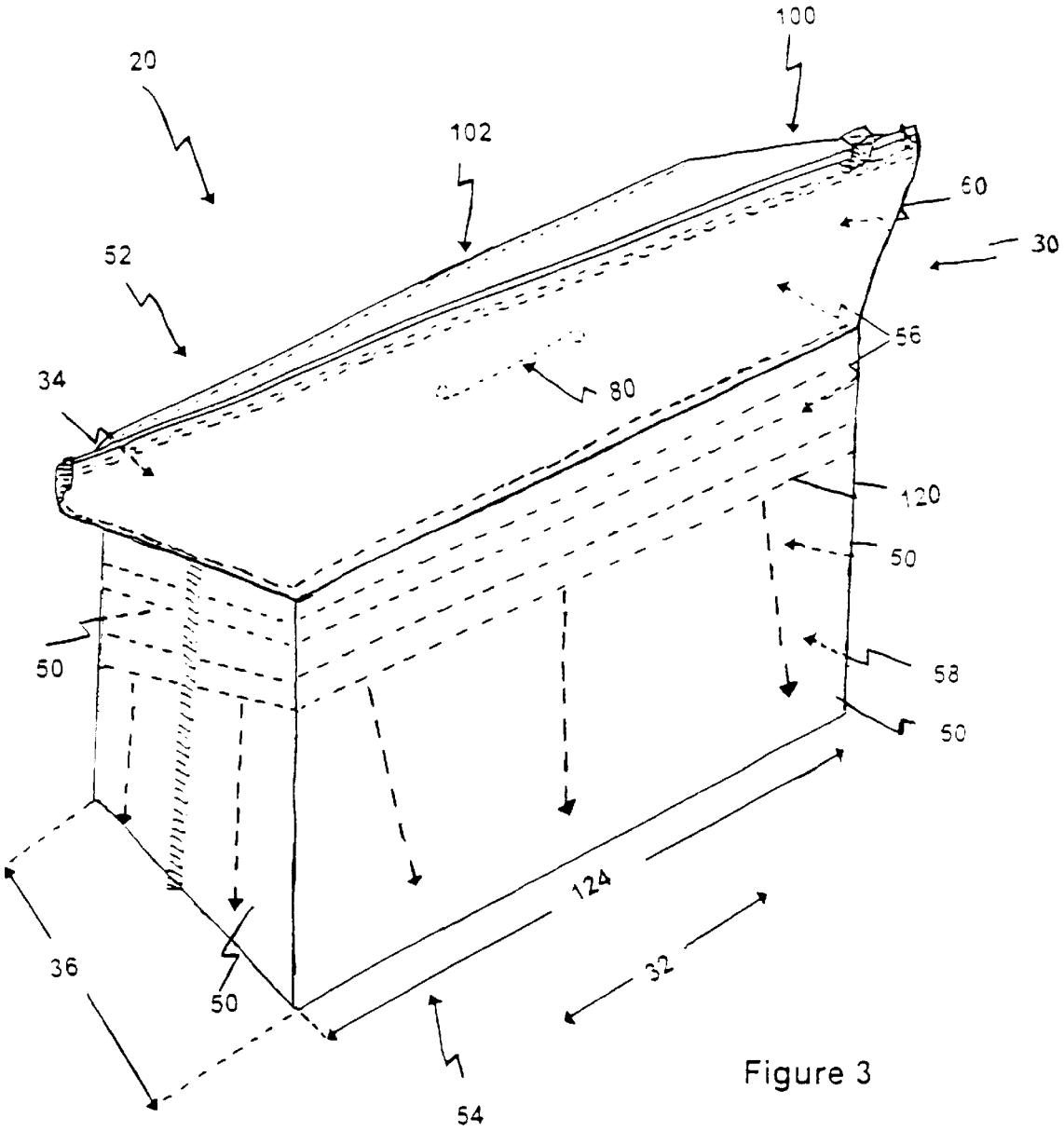
FIG. 3 representatively shows a perspective view of an example of a package for wipes according to the present invention before dispensing any wipes and in a closed position, with wipes and dispensing orifice shown in phantom inside the package.
Figure 4:
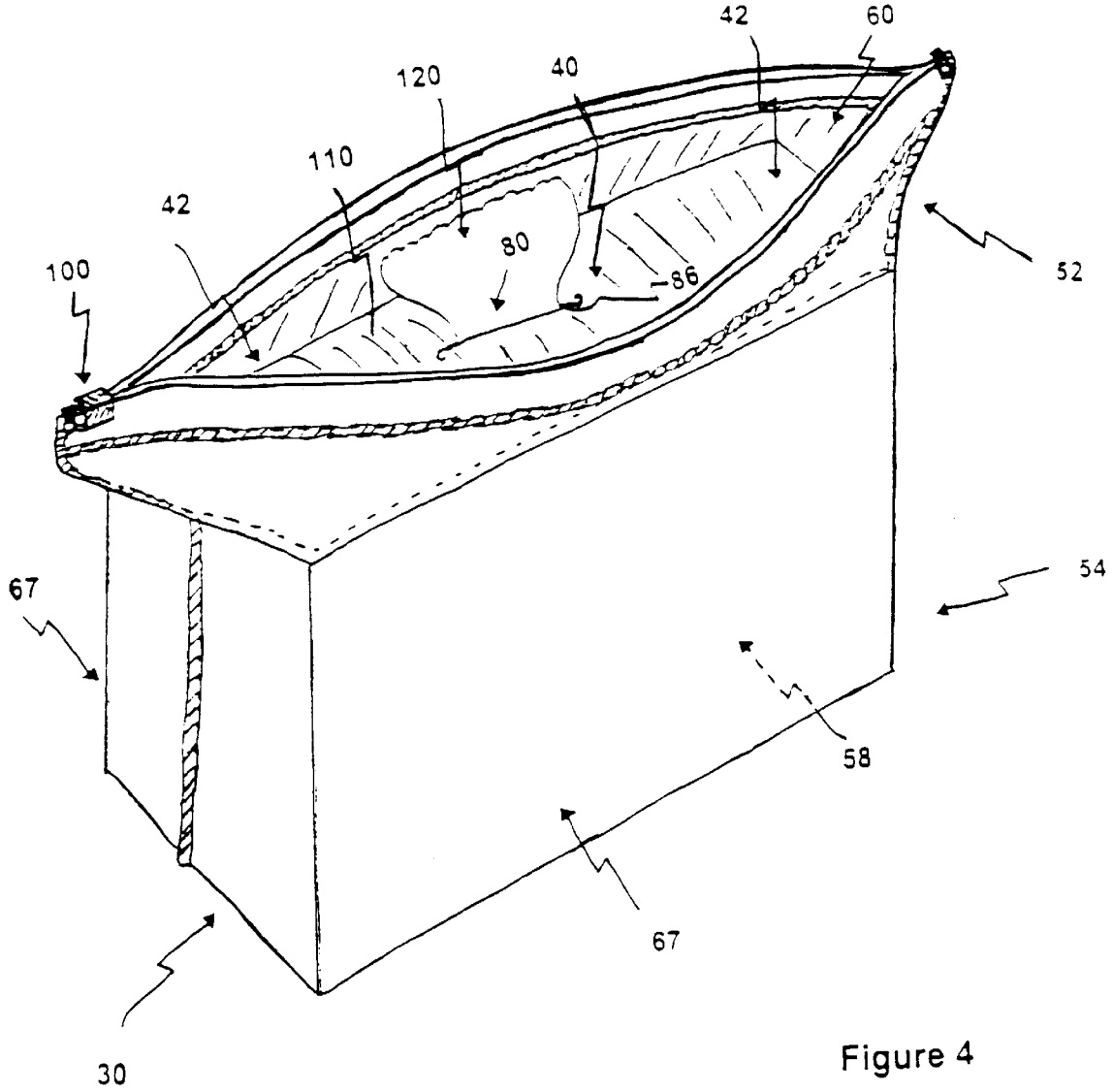
FIG. 4 representatively shows a perspective view of the package for wipes illustrated in FIG. 3 with a wipe partially dispensed and in an open position.
Figure 4A:
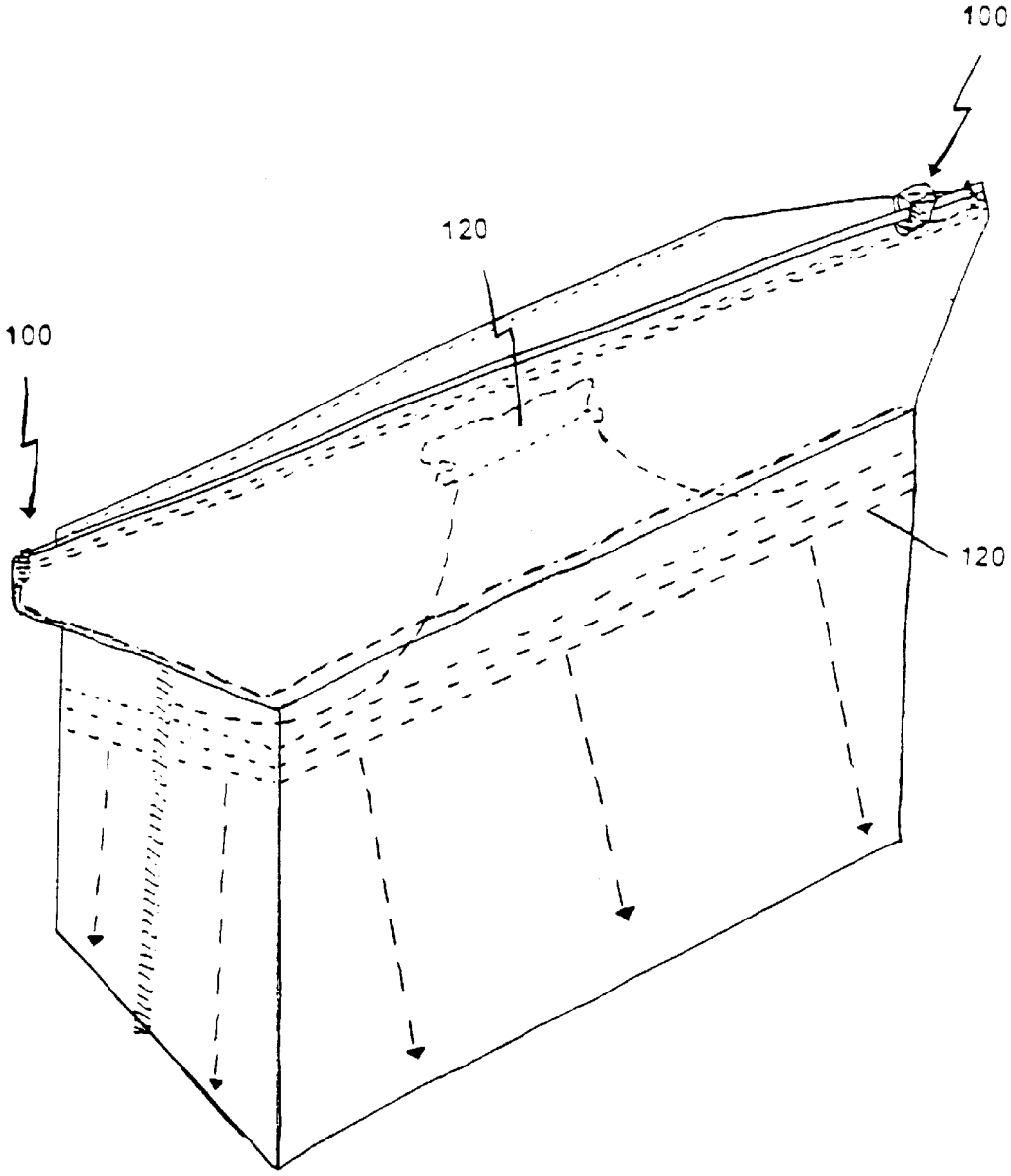
FIG. 4A representatively shows a perspective view of the package for wipes illustrated in FIG. 4 with the wipe partially dispensed and in the closed position.

The cavity 56 includes a storage portion 58 for wipes 120. The top end portion 52 can include a resealable mechanism 100. A non-rigid baffle structure 110 has a width 112 and is located in between the resealable mechanism 100 and the storage portion 58 with the baffle structure 110 positioned between opposing sides 50 of the container spaced apart from each other. The baffle structure thereby defines a dispensing portion 60 of the cavity 56 overlying the storage portion 58 of the cavity. It is noted that "overlying" merely defines the positioning of dispensing portion 60 relative to the storage portion 58 when the package 20 is positioned in an upright position, e.g., as seen in FIG. 3. The invention also functions to dispense wipes when the package 20 is sideways or in the upside-down position (not shown). The baffle structure 110 includes a dispensing orifice 80 through which wipes 120 can pass and communicate with the dispensing portion 60.

Figure 5:
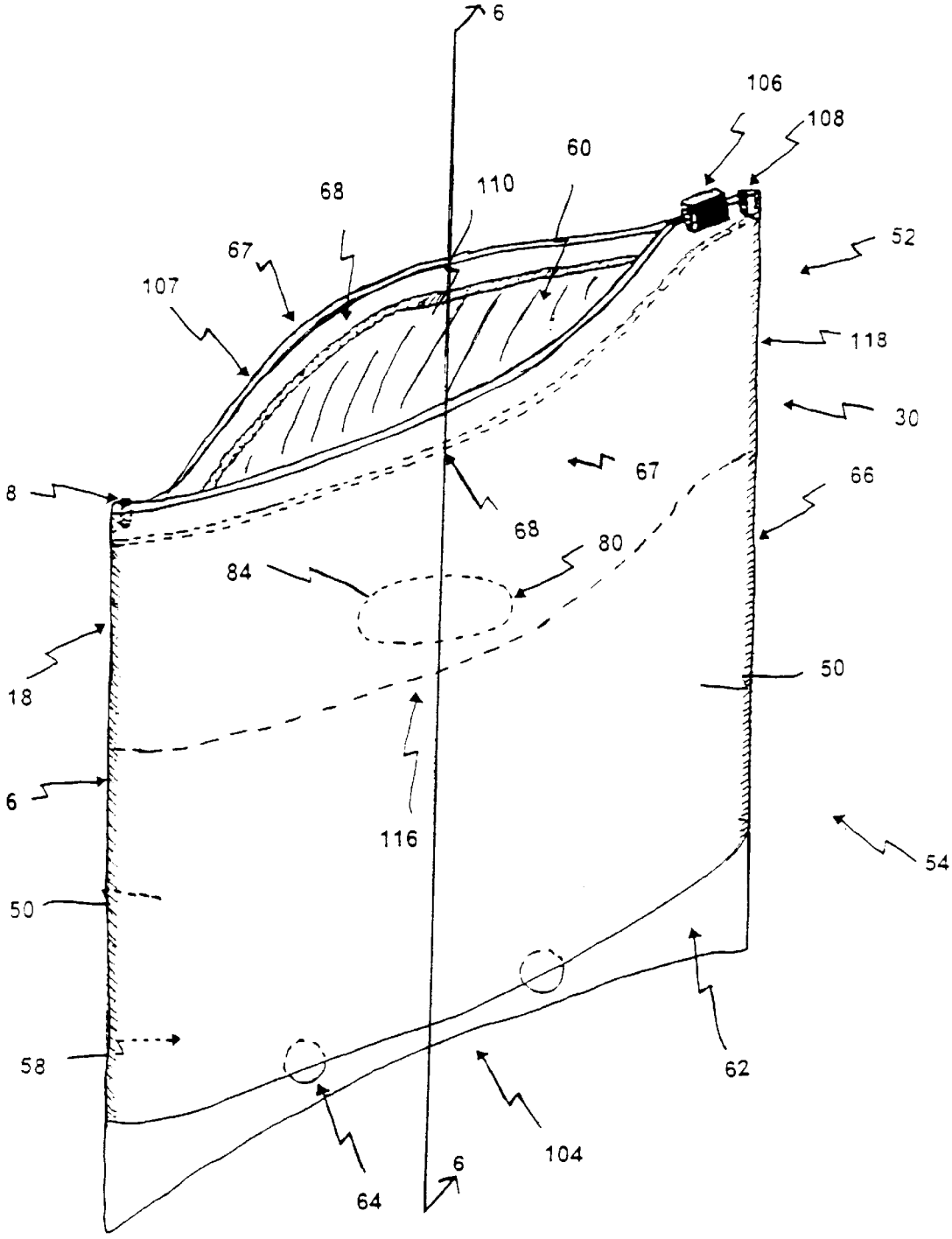
FIG. 5 representatively shows a perspective plan view of a package for wipes similar to that illustrated in FIG. 3, with an alternate dispensing orifice and with a bottom end portion open prior to complete assembly and having wipes positioned in the package.
Figure 6:
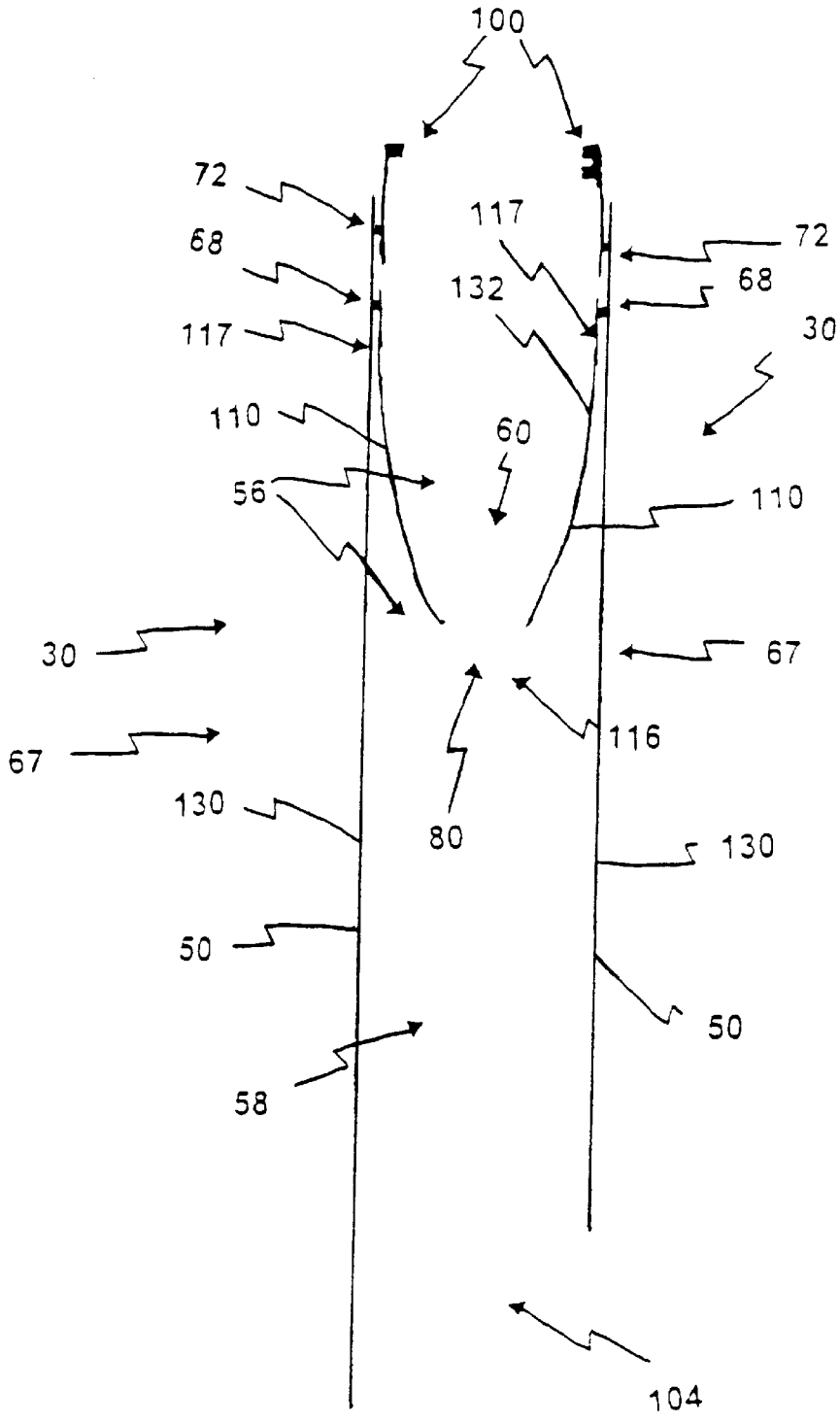
FIG. 6 representatively shows a cross-sectional view of the package for wipes illustrated in FIG. 5, taken along the line 6—6.
Figure 6A:
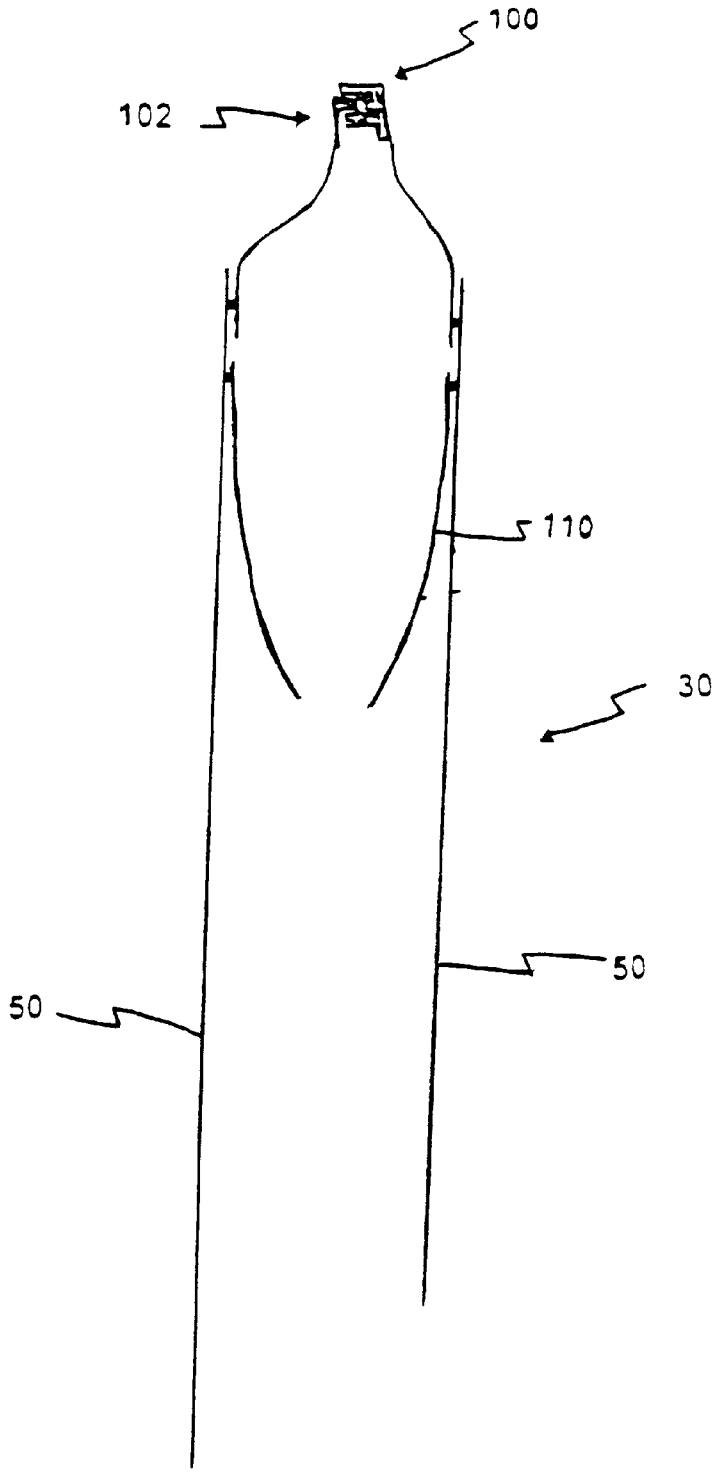
FIG. 6A representatively shows a cross-sectional view of the package for wipes illustrated in FIG. 5, taken along the line 6—6, but here with in a resealable mechanism sealed closed.
Figure 7:
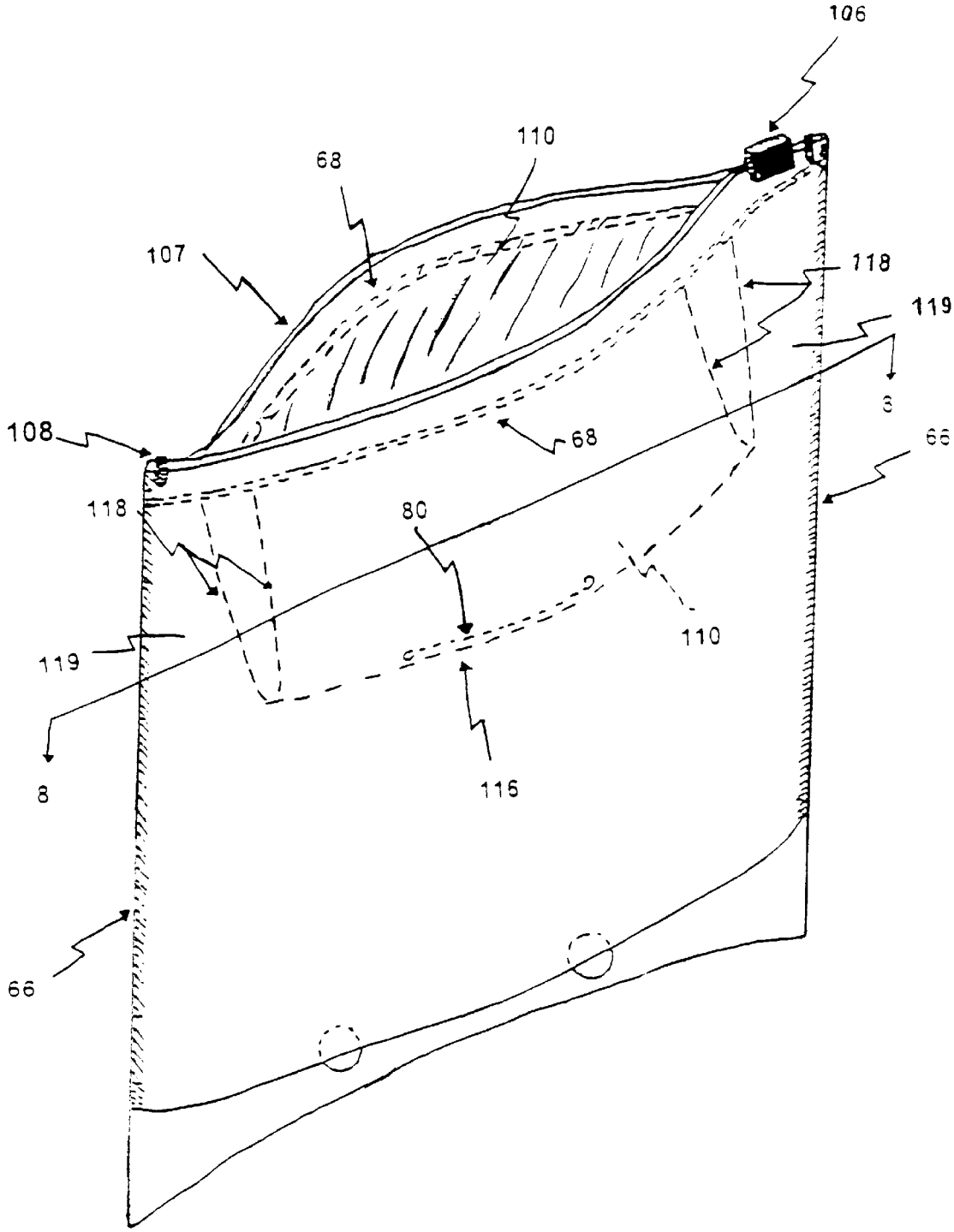
FIG. 7 representatively shows a perspective plan view of a package for wipes similar to that illustrated in FIG. 3, with an alternate baffle structure and prior to complete assembly and having wipes positioned in the package.

As seen in FIGS. 3, 4A, 6A, and 27, the resealable mechanism 100 is in a sealed closed position 102, whereas in the other FIGS. it is in an open position with and without wipes 120 inside the container. The mechanism 100 can be any type of mechanism that allows the package 20 to be opened, closed and reopened multiple times during the life of the package, e.g., a zipper with or without a slider, resealable adhesive, a clip or other structure that achieves the result desired here. Such a zipper may be a plastic zipper with a zipper track 107 and attached flange which allows the track to be joined to the container 30 (e.g., FIG. 5). The zipper can include a slider 106 which slides along the track 107 to seal and unseal two sides of the track from each other. An end clip 108 can engage the track to prevent the slider 106 from falling off the ends of the track 107. Such a plastic zipper mechanism is commercially available from Pactiv Corporation located at 1900 W. Field Court, Lake Forest, Ill. 60045 under the trademark Slide-Rite®. In FIGS. 5 to 7, inclusive, 9,10 and 28, the bottom end portion 54 is in an open position 104, whereas in the other FIGS. it is sealed closed.

Figure 13:
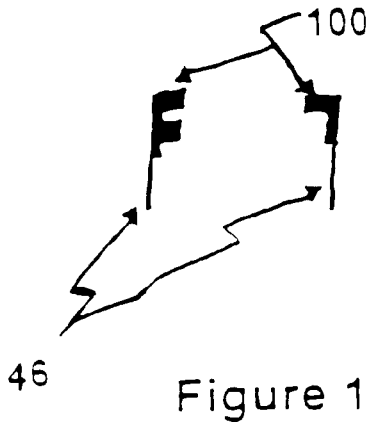
FIG. 13 representatively shows a partial cross-sectional view of an example of a resealable mechanism for use in the present invention.
Figure 14:
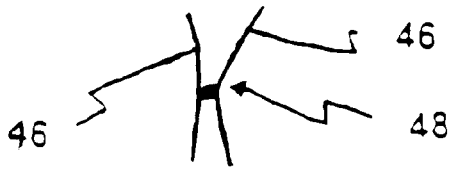
FIG. 14 representatively shows a partial cross-sectional view of an example of a seal between layers of film for use in the present invention.
Figure 15:
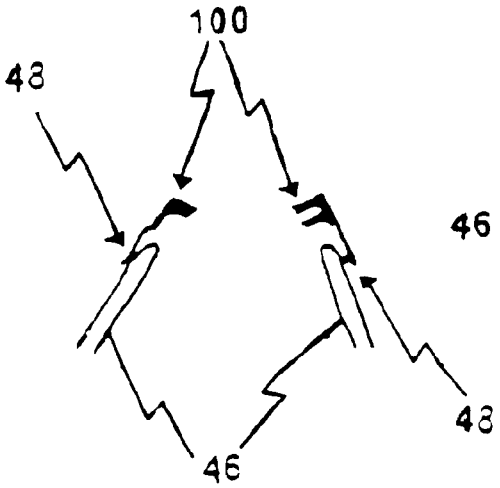
FIG. 15 representatively shows a partial cross-sectional view of an example of an alternate resealable mechanism configuration for use in the present invention.
Figure 16:
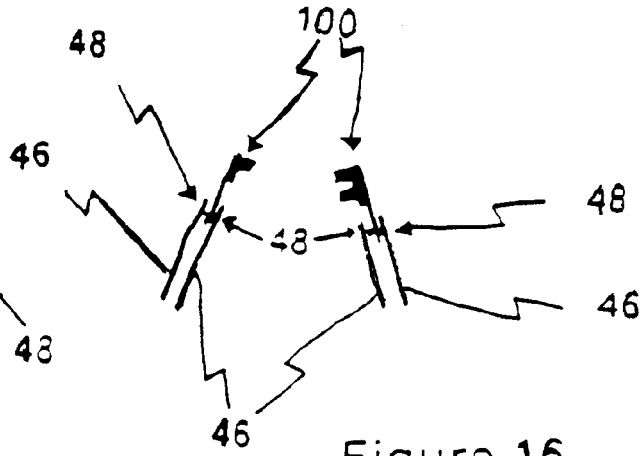
FIG. 16 representatively shows a partial cross-sectional view of an example of another alternate resealable mechanism configuration for use in the present invention.
Figure 17:
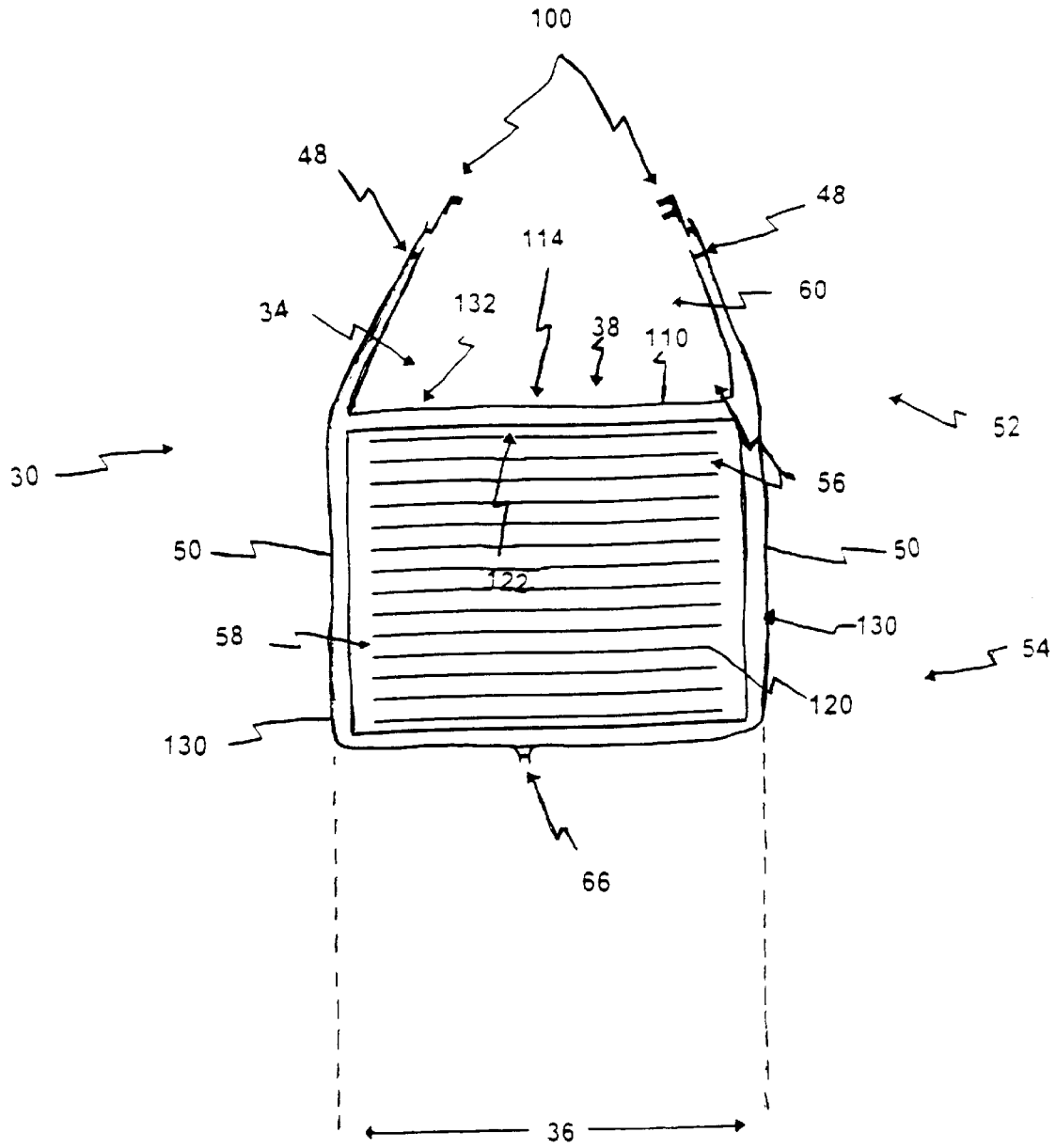
FIGS. 17–24 representatively show a cross-sectional view of several additional examples of a package for wipes according to the present invention before dispensing any wipes and in an open position, with wipes positioned inside the fully assembled package.
Figure 18:
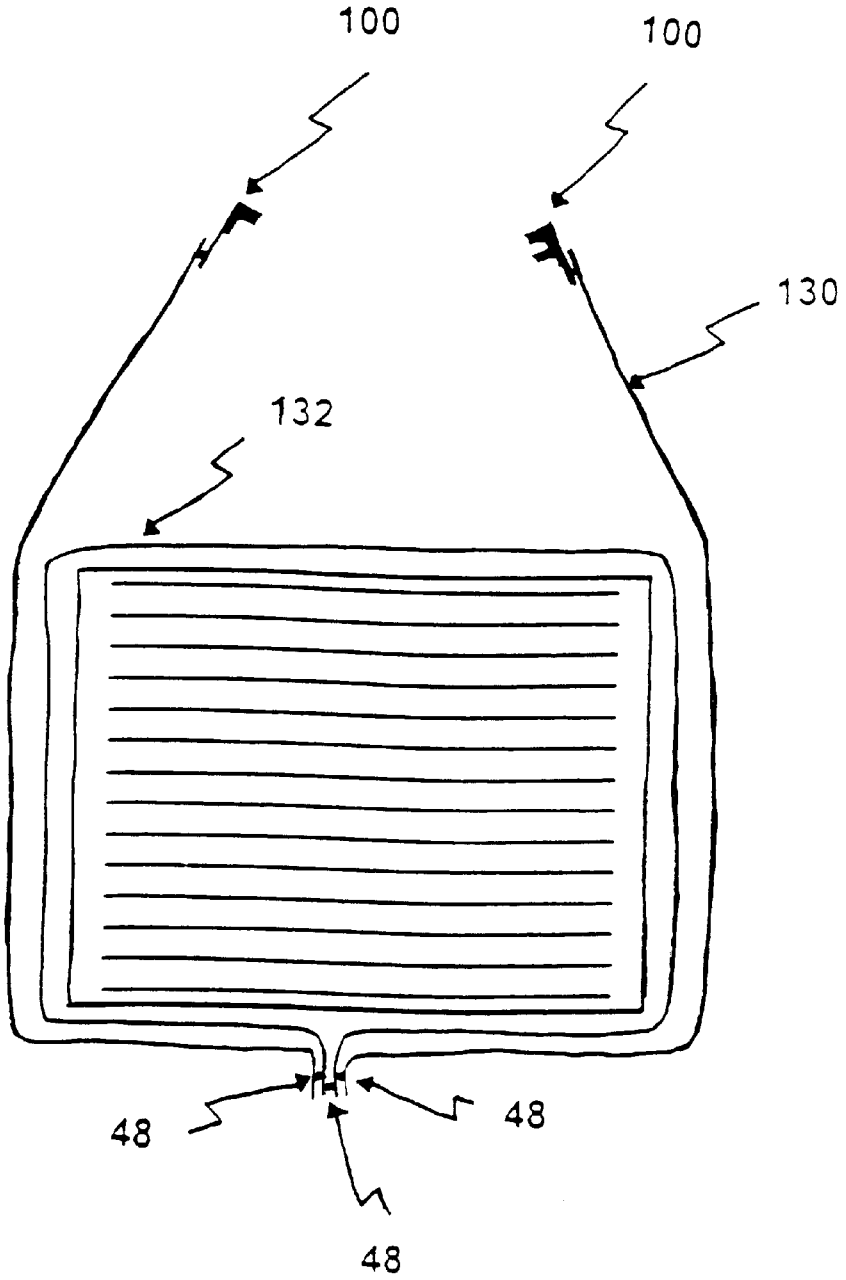

Referring to representative FIGS. 13, 15 and 16, there are depicted various configurations for the resealable mechanism 100 (in additional to those seen throughout the other FIGS.). FIG. 13 generically represents a resealable mechanism for use with the present invention. It has package material extending down therefrom forming a flange for joining to the container 30 when desired. FIGS. 15 and 16 show alternative configurations for joining the flange of the resealable mechanism to the container at attachment locations 48 (defined below).

The invention provides various baffle structure characteristics, configurations and orientations, which the inventors have discovered contribute to the operation and efficiency of the package for storing and dispensing wipes. These characteristics, configurations and/or orientations can enhance the hygienic nature of the wipes 120 by keeping more of the wipes separated from an outside environment even when the resealable mechanism 100 is open for dispensing a wipe through the dispensing orifice 80 (e.g., FIG. 4). Additionally, the baffle structure 110 can enhance the moisture retention of the package 20, especially when the resealable mechanism 100 is open (e.g., FIG. 4). Still additionally, the baffle structure 110 can enhance dispensing of the wipes 120, particularly for one-at-a-time dispensing in (i) a popup format where each wipe is held in the dispensing orifice 80 (e.g., FIGS. 4 and 4A) while awaiting dispensing by a user or (ii) a reach-in format where each wipe is accessible through the dispensing orifice 80 but is not retained in the dispensing orifice while awaiting dispensing by a user. Additionally in this regard, the baffle structure 110 can enhance dispensing by providing a more accessible dispensing portion 60. That is, when a user opens the resealable mechanism 100 to gain access to the dispensing portion 60 the mouth formed at the top end portion 52 of the container can open as wide as permitted by the baffle structure positioned between opposing sides 67, at least at a center portion 40 of the container.

The baffle structure 110 can have a collapsible-expandable characteristic. This characteristic defines the ability of the baffle structure as a whole to expand and collapse between the sides 50 of the container 30. This may be due, e.g., to the flexible nature of the sides 50 in combination with the non-rigidity of the baffle structure, to the size of the baffle structure relative to the distance between opposing sides 66, to a combination of these, or to any other mechanism by which the baffle structure as a whole (i.e., in contrast to merely the dispensing orifice 80 in the baffle structure) can expand and collapse between the sides 50 of the container 30. For example, referring to FIG. 28, a width 112 of the baffle structure can be less than a width 36 of the container as long as it has at least some width to allow some separation between opposing sides 67 (FIG. 5) of the container when the resealable mechanism is in the open position. Alternatively, the width of the baffle structure can be greater than the width 36 of the container, e.g., see FIG. 10 among others. Here, the width 112 of the baffle structure includes not only dimension 166, but also dimension 168 twice, for a total extended baffle width of about 230 mm as seen in representative FIG. 10. Further, the width 112 is preferably at least as great as the width of the container, more preferably at least about 1.5 times as great as the width of the container, and most preferably at least about 2 times as great as the width of the container and not more than about 3 times as great as the width of the container.

Referring to FIGS. 3 to 4A and 17, e.g., a configuration and orientation for baffle structure 110 is where a center area portion 114 of the baffle structure is oriented substantially parallel to an adjacent surface area 122 of the wipes 120 which are positioned within the storage portion 58 of the cavity. For example, such provides close access to the underlying wipes should a partially dispensed wipe inadvertently fall back into storage portion 58. Also, e.g., such assists in maintaining a partially dispensed wipe in that position while awaiting next dispensing. For similar reasons, another configuration and orientation for baffle structure 110 is where the center area portion 114 of the baffle structure rests on an adjacent surface area 122 of the wipes which are positioned within the storage portion 58 of the cavity.

Figure 27:
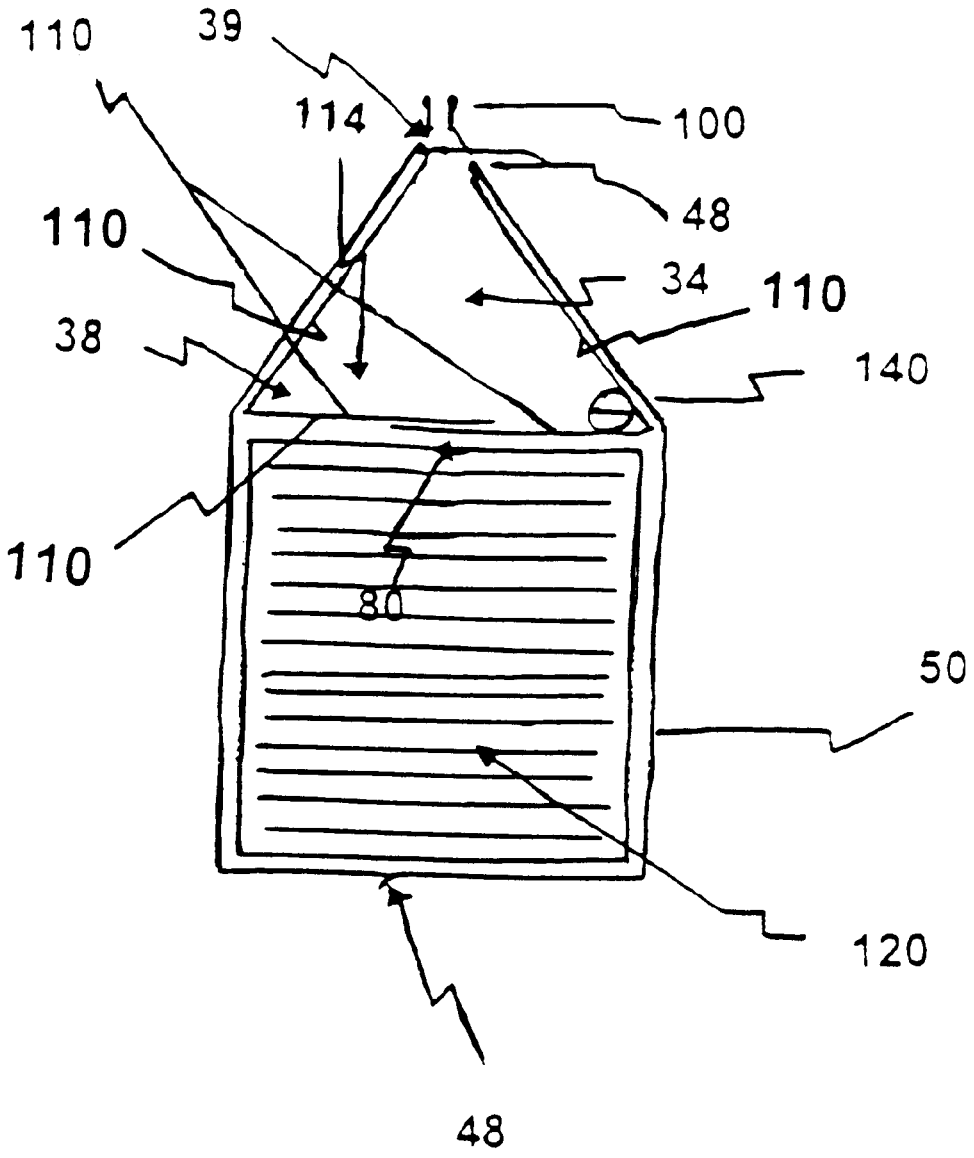
FIG. 27 representatively shows a cross-sectional view of another example of a package for wipes according to the present invention before dispensing any wipes and in a closed position, with wipes positioned inside the fully assembled package and a personal or promotional item loosely retained in the dispensing portion.
Figure 28:
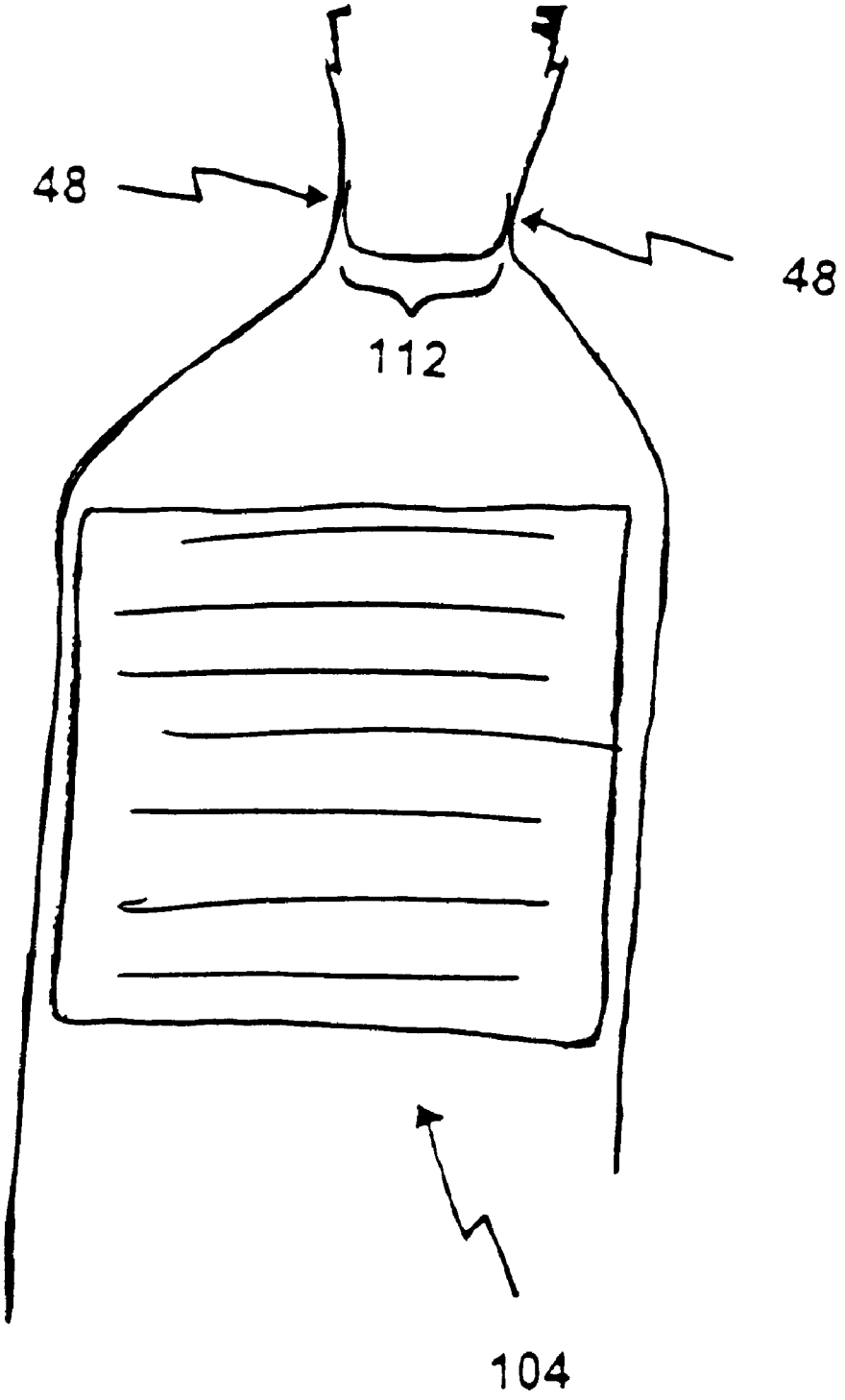
FIG. 28 representatively shows a cross-sectional view of another example of a package for wipes according to the present invention before dispensing any wipes and in an open position, with wipes positioned inside the partially assembled package.

Now also referring to FIG. 27, e.g., for reasons similar to those just discussed, as well as for additional ones, the dispensing portion can expand to have a triangular shaped cross-sectional dimension 34, for example, when the resealable mechanism 100 is sealed closed and wipes 120 are positioned within the storage portion 58. Such dimension 34 is defined by an imaginary plane passing through the top and bottom end portions and through the width 36 of the container, as best exemplified in FIG. 27. Further, a base 38 of the triangular shaped cross-sectional dimension of the dispensing portion can be adjacent the baffle structure and an apex 39 of the triangular shaped cross-sectional dimension can be spaced from the baffle structure. Additionally, the dispensing portion 60 can be sized and configured to loosely retain a personal or promotional item 140 in between the baffle structure 110 and the resealable mechanism 100 when the resealable mechanism is sealed closed. A personal item could be lotion, personal care product or, e.g., other product that may be used in conjunction with wipes.

Figure 19:
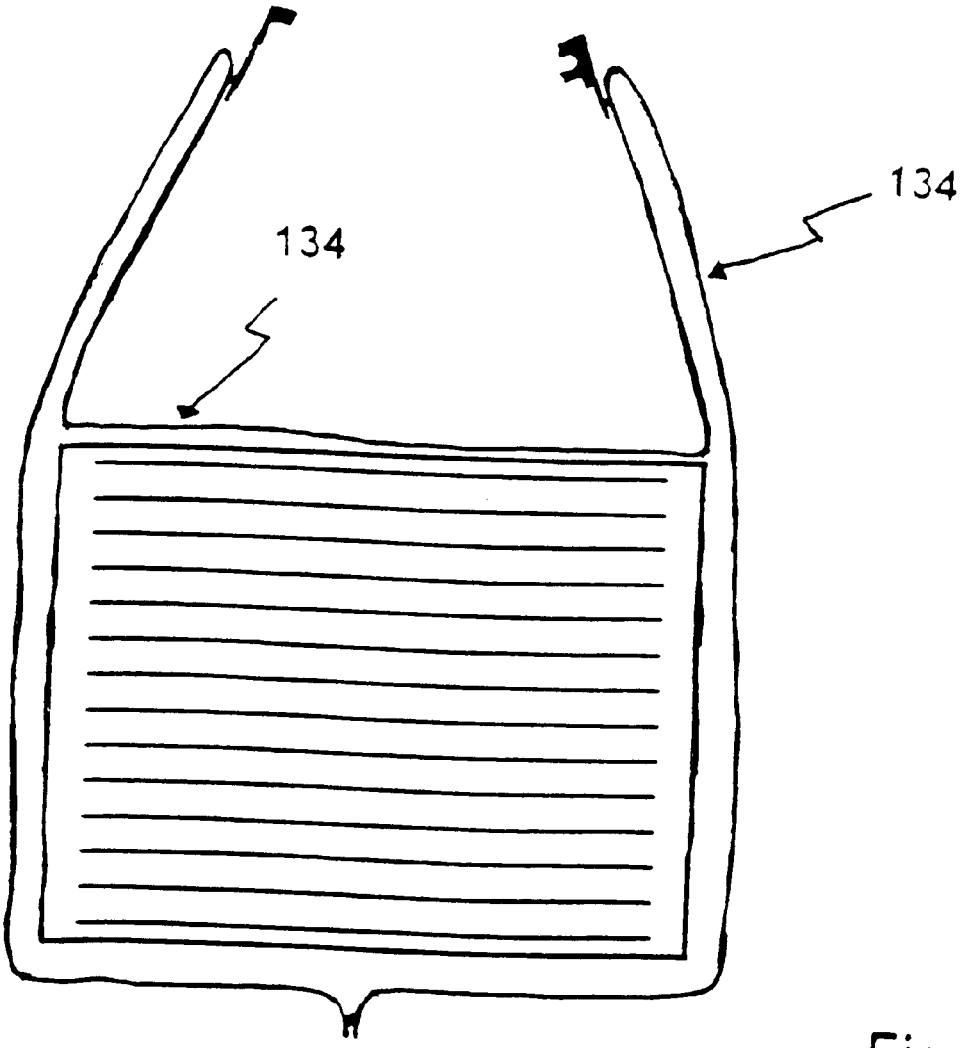
Figure 20:
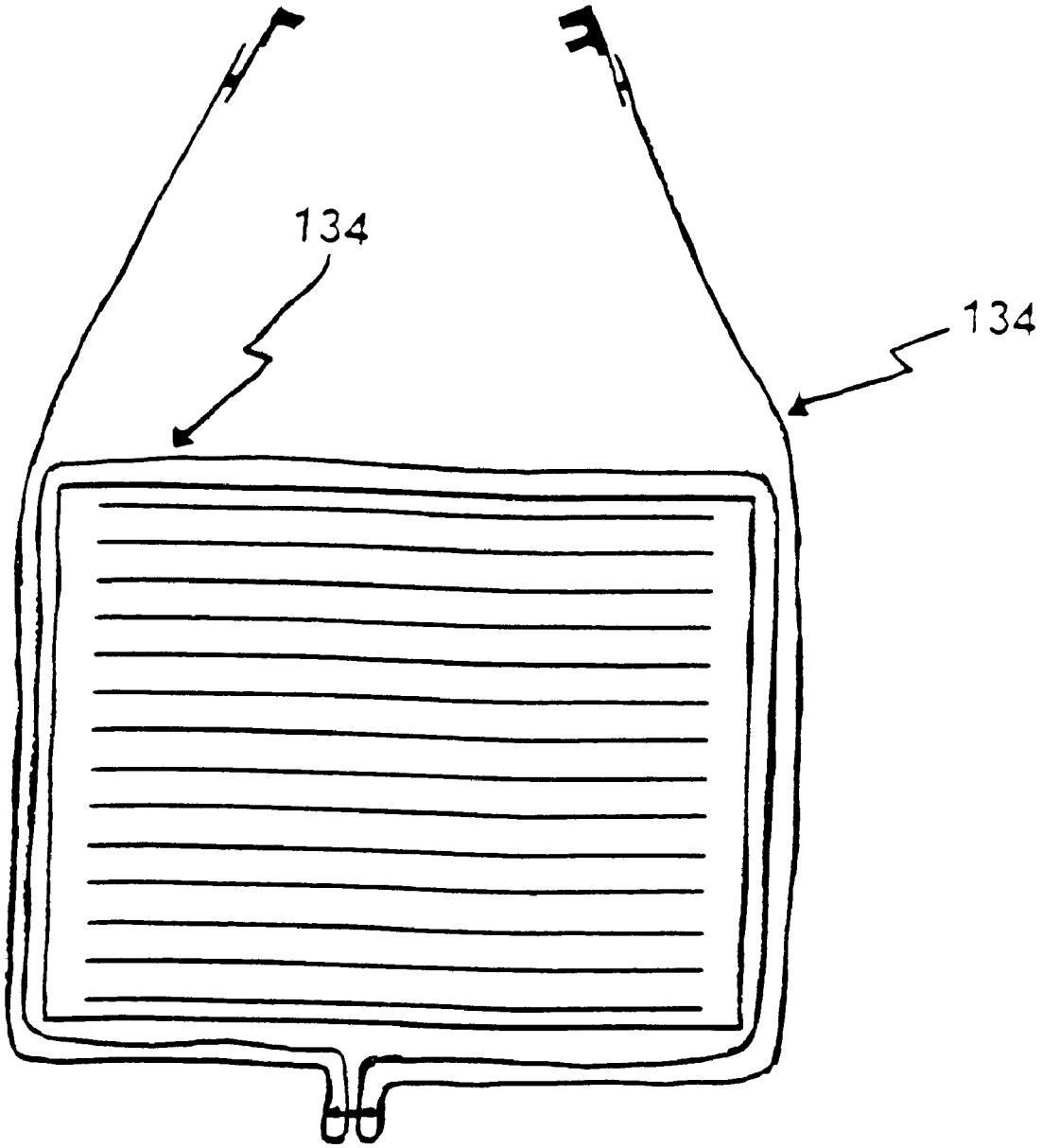
Figure 21:
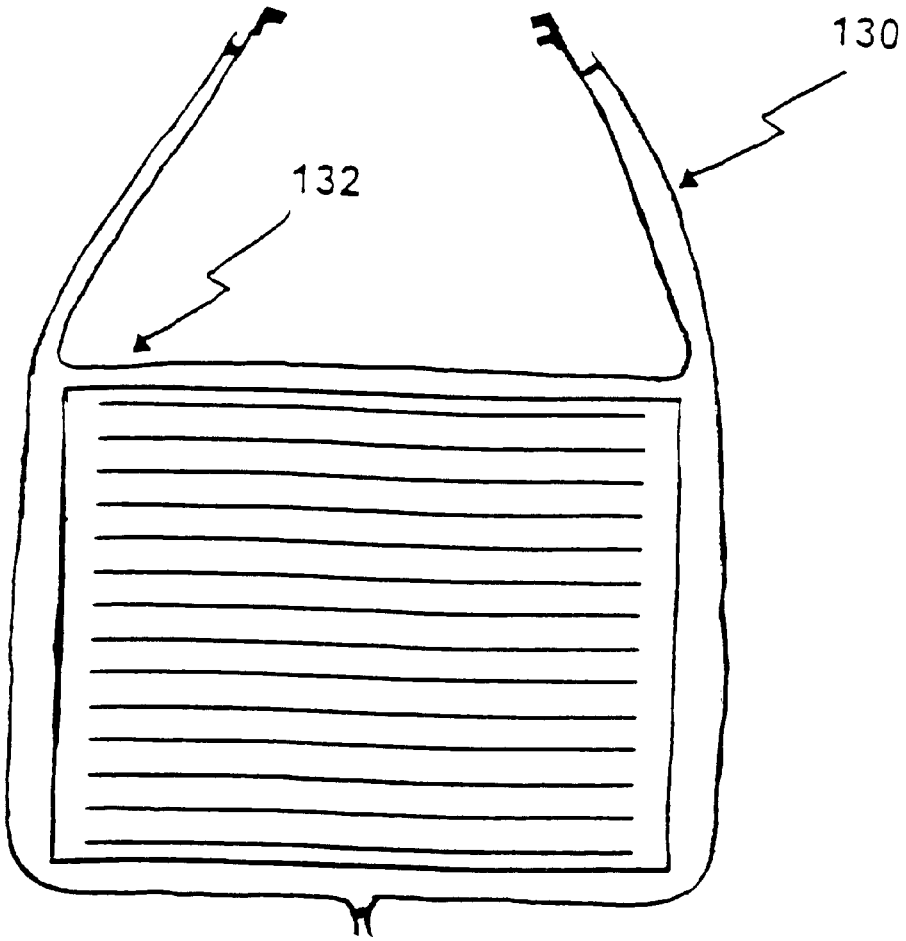
Figure 25:
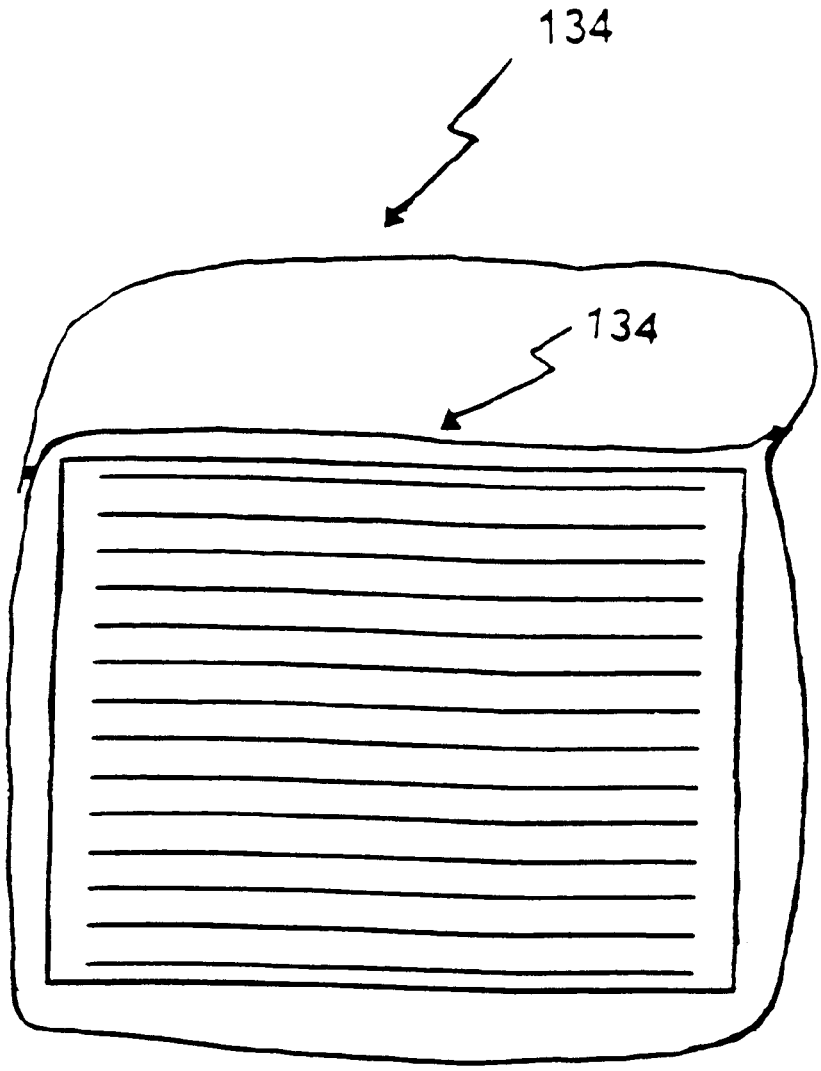
FIG. 25 representatively shows a cross-sectional view of another example of a package for wipes according to the present invention before dispensing any wipes and in a closed position, with wipes positioned inside the fully assembled package.
Figure 26:
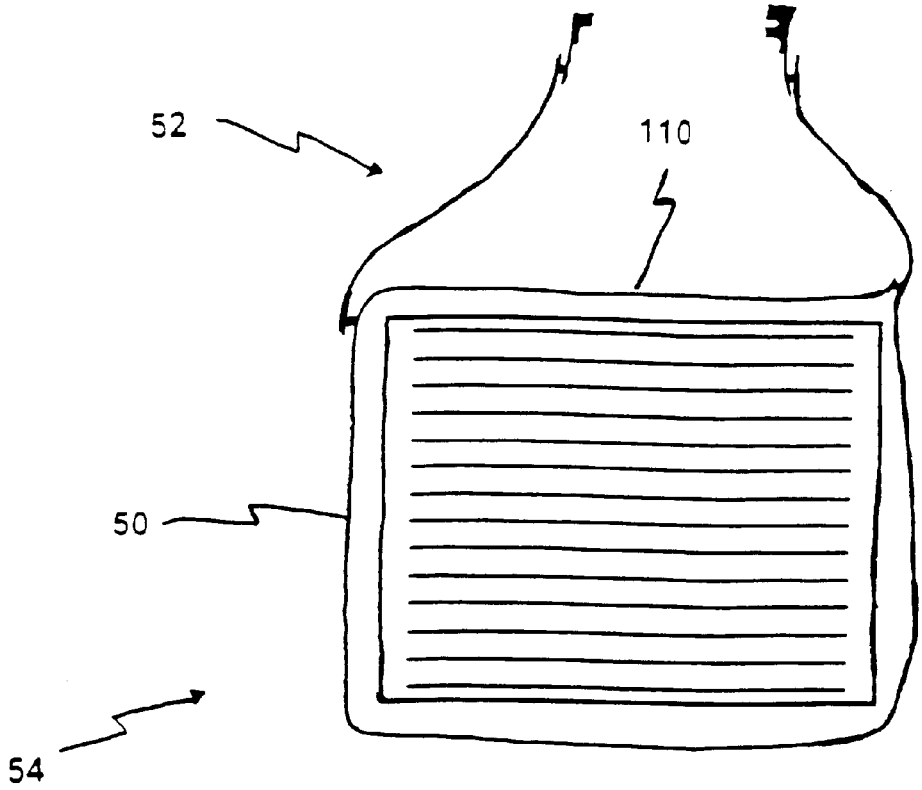
FIG. 26 representatively shows a cross-sectional view of another example of a package for wipes according to the present invention before dispensing any wipes and in an open position, with wipes positioned inside the fully assembled package.

Referring to FIGS. 15 to 27, inclusive, e.g., the package 20 of the present invention can be formed from various configurations. For example the container 30 can be a first piece of material 130 and the baffle structure 110 can be formed from a second piece of material 132 separate from the first piece of material. Here, "separate" means that at some time prior to formation of the package 20 the first piece of material 130 is not joined to the second piece of material 132. Then, after formation the two pieces 130 and 132 are joined together, such as seen in FIGS. 17,18, 21, 22 to 24, 26 and 27. Alternatively, the container 30 and the baffle structure 110 can be formed from one continuous piece of material 134, such as seen in FIGS. 19, 20 and 25. As exemplified in FIGS. 22 and 23, the wipes 120 may be positioned in a pre-assembled container similar to that seen in FIGS. 1 and 2, and then incorporate into a package configuration of the present invention. Particularly for this embodiment, but also generally possible throughout, the baffle structure 110 can be joined to the container 20 for little or no movement relative to the container in a longitudinal direction 32 (FIG. 3) of the container 30.

Figure 29:
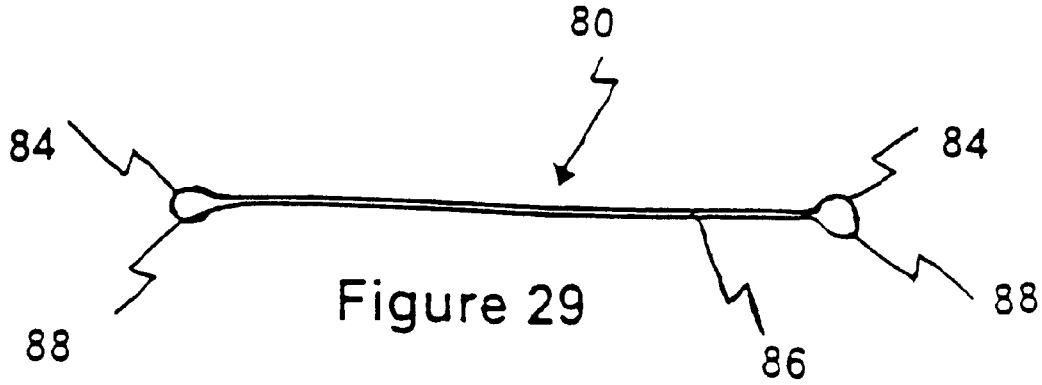
FIGS. 29–32 representatively show a top plan view of additional examples of configurations of a dispensing orifice for use in the present invention.
Figure 30:
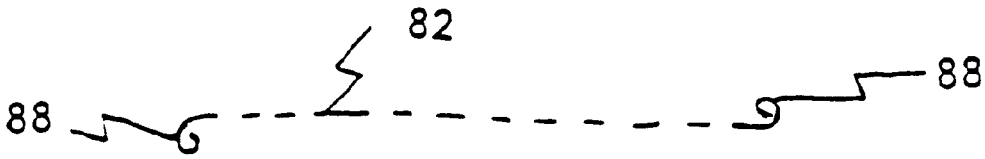
Figure 31:
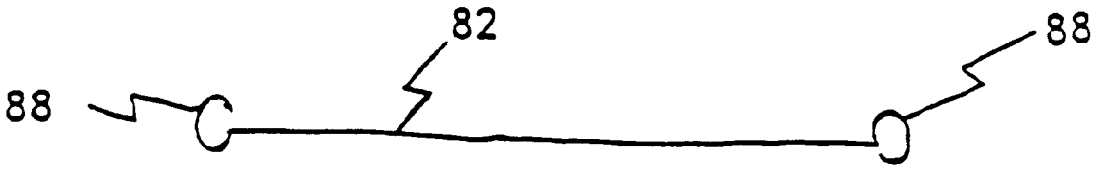
Figure 32:
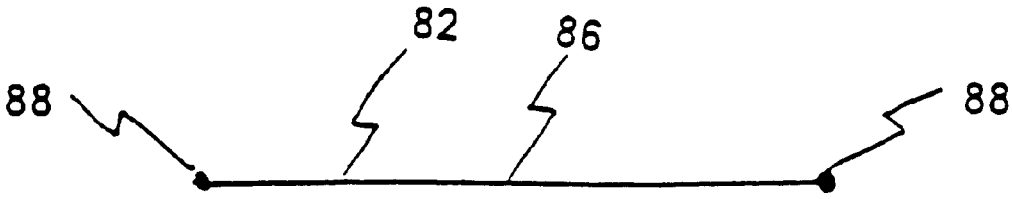
Figure 33:
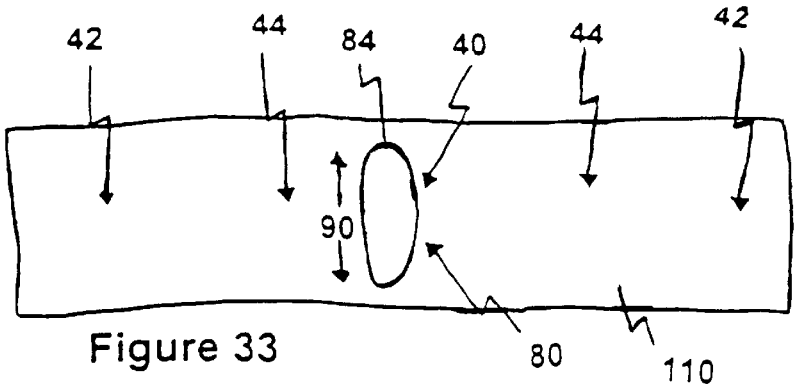
FIGS. 33–36 representatively show a top plan view of additional examples of orientations of a dispensing orifice for use in the present invention.

Referring to representative FIGS. 27 and 29 to 36, the invention provides dispensing orifice 80 having various possible characteristics. The dispensing orifice 80 can be a frangible seal 82, such as formed by a perforated pattern with intermittent broken segments or merely weakened segments (FIG. 30). Alternatively, frangible seal 82 can be merely a weakened line of material (FIG. 31) which does not allow a fluid to pass therethrough until first broken. For example, seal 82 can, upon manufacture, be sealed closed (i.e., partially or completely as just discussed) and then opened for the first time by a user. In this way the frangible seal can serve as a tamper proof seal where a broken seal will evidence possible compromise of the integrity of the wipes inside. Alternatively, orifice 80 can be a slit 86 with a slight opening along its length (FIG. 29) or with no apparent opening along its length (FIG. 32) due to merely cutting the orifice material without removing any or pre-forming a slit as in FIG. 29. When the orifice 80 is a slit, it may be of any length desirable for dispensing wipes, e.g., it may be 60 mm and have 5 mm die-cut circles acting as anti-tear end portions 88 (FIG. 29). When the orifice is a slit, it can also include an anti-tear end portion 88, so that during use the orifice 80 better maintains its original size and shape. Yet alternatively, orifice 80 may be a hole 84 (FIGS. 33 to 36), a combination of a slit and a hole (FIG. 29) or a combination of any of these. Still alternatively, baffle structure 110 may be formed from two separate pieces of material (FIG. 27) which overlap at the center area portion 114 and thereby form an orifice 80 within the points of overlap. Preferably the baffle is also made from a non-oriented polymeric film to further inhibit tearing.

Figure 34:
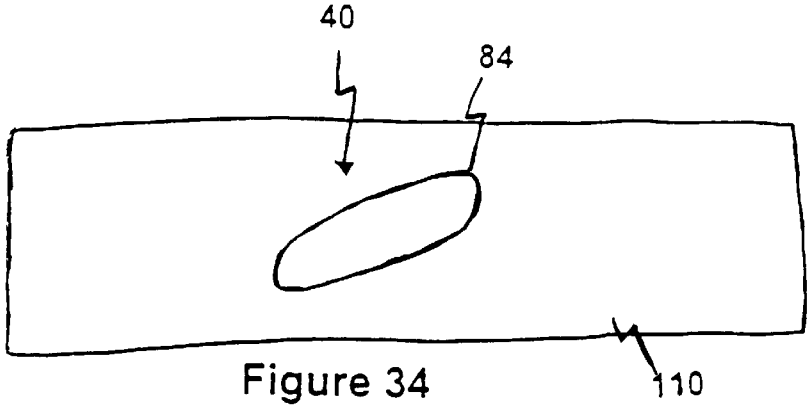
Figure 35:
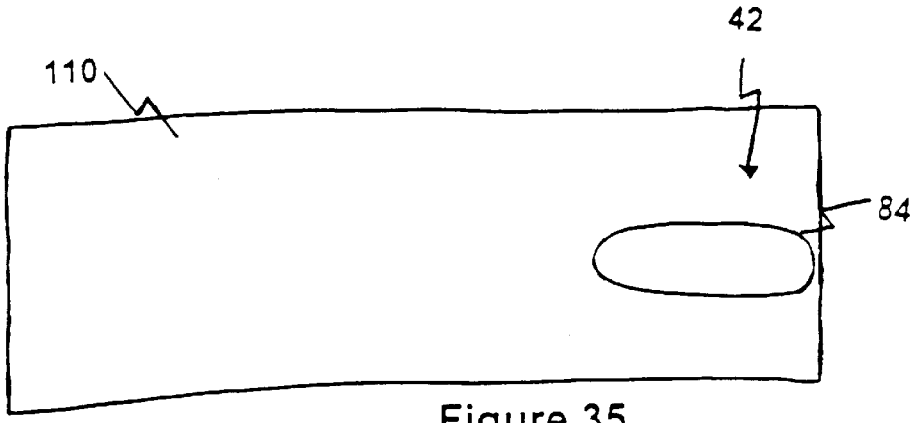
Figure 36:
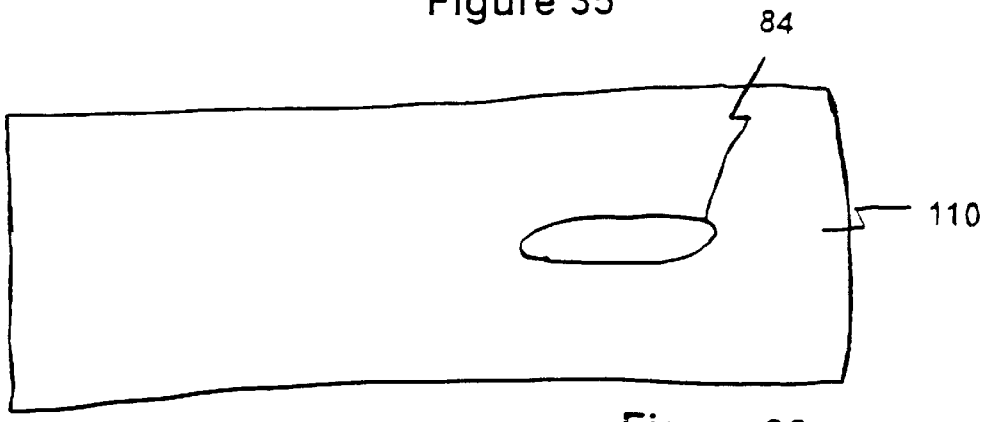

The dispensing orifice 80 can be oriented so a longitudinal dimension 90 (FIG. 33) of the orifice is positioned approximately parallel with a length 124 of the wipes 120 (FIGS. 4, 25 and 36), approximately perpendicular with the length of the wipes (FIG. 33) or approximately diagonally with the length of the wipes (FIG. 34). Additionally, the orifice can be located relative to the longitudinal axis 32 of the container 30 at a position including a center portion 40 of the container (FIGS. 4, 33 and 34), an end portion 42 of the container (FIGS. 4 and 35) and between an end portion 42 of the container and a center portion 40 of the container (FIG. 36). Such orifice characteristics assist a user in dispensing wipes, e.g., accessing the wipes, holding a wipe in a partially dispensed position awaiting later dispensing, reducing exposure of a majority of the non-dispensed wipes to an outer environment even when the resealable mechanism is open, and the like.

Figure 8:
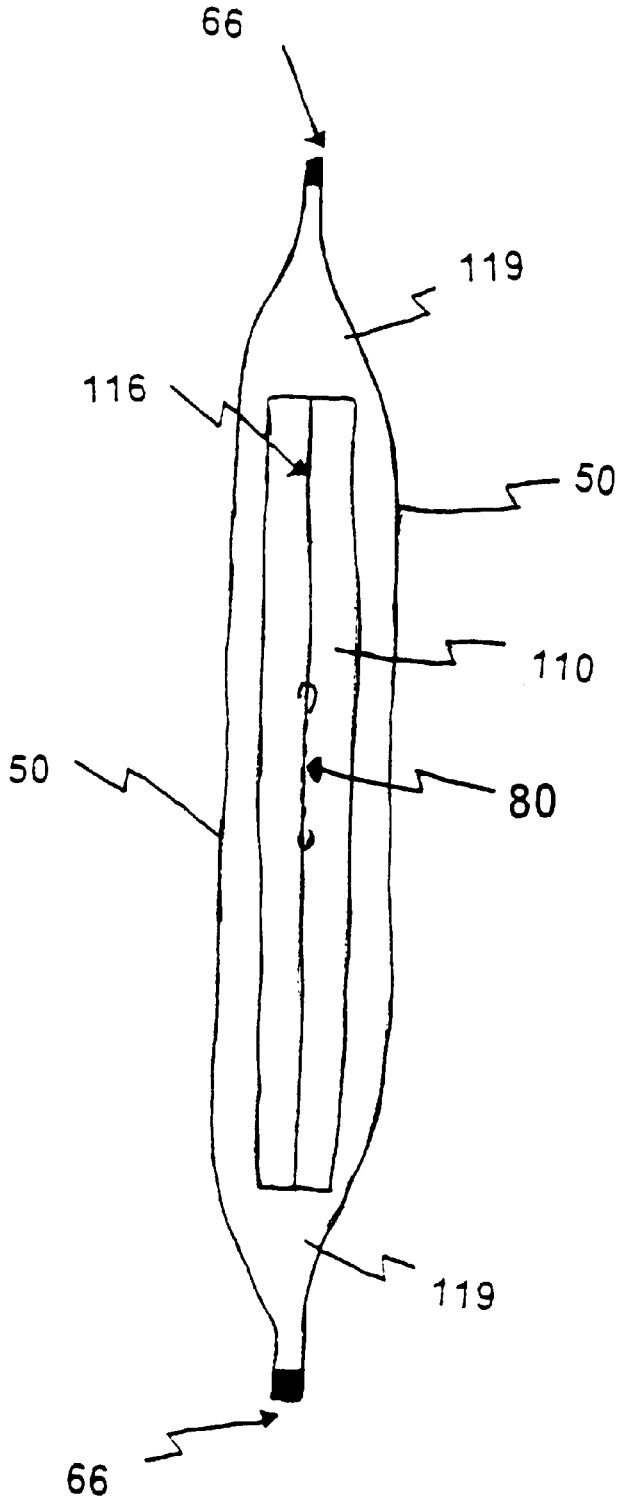
FIG. 8 representatively shows a cross-sectional view of the package for wipes illustrated in FIG. 7, taken along the line 8—8.

Referring to the figures and FIGS. 5 to 10 for discussion purposes now, package 20 can be made, for example, by first assembling container 30 and baffle structure 110 generally as shown without wipes 120 therein. Sides 30 can comprise one or two pieces of material (two pieces joined at opposite sides 66 or a single piece of material folded over at one side 66 and then joined only at the other side 66). Baffle structure 110 can be joined into the sides 66 of the container sides 50 and/or joined at its top portions 117 to opposing container sides 67 along some or all of zone 68 (e.g., see FIGS. 5 to 8). In these ways the baffle structure 110 spans between opposing sides 66 and/or 67 of the container 30. Alternatively, baffle structure 110 can be free at its opposite ends 118 and joined with the container 30 merely where opposing sides 67 join the baffle structure's top portions 117 along some or all of zone 68 (FIGS. 7 and 8). In this way, a space 119 exists between baffle ends 118 and adjacent container sides 66. Thus, dispensing portion 60 can communicate with storage portion 58 through spaces 119 (and also through the dispensing orifice 80 if it is hole 84 or slit 86 without frangible seal or with a broken frangible seal). Yet alternatively, baffle structure 110 can be free at its top portions 117 and joined with the container 30 merely at baffle opposite ends 118 to respective container sides 66 (not shown but as would be readily understood based on the above discussion).

If all opposite top portion 117 or ends 118 of the baffle structure are joined to respective opposing sides 67 and 66 of the container (e.g., FIGS. 5 and 6) then the baffle structure can span between the opposing sides of the container and completely separate the storage portion 58 of the cavity from the dispensing portion 60 except at the dispensing orifice 80 (i.e., when the dispensing orifice 80 is a hole 84 or slit 86 without frangible seal or with a broken frangible seal). Additionally, if the package 20 of FIG. 5 also has a dispensing orifice with slit 82 having a frangible seal unbroken (FIG. 7), then the baffle structure 110 can span between the opposing sides of the container and completely separate the storage portion of the cavity from the dispensing portion of the cavity, even at the dispensing orifice.

Figure 22:
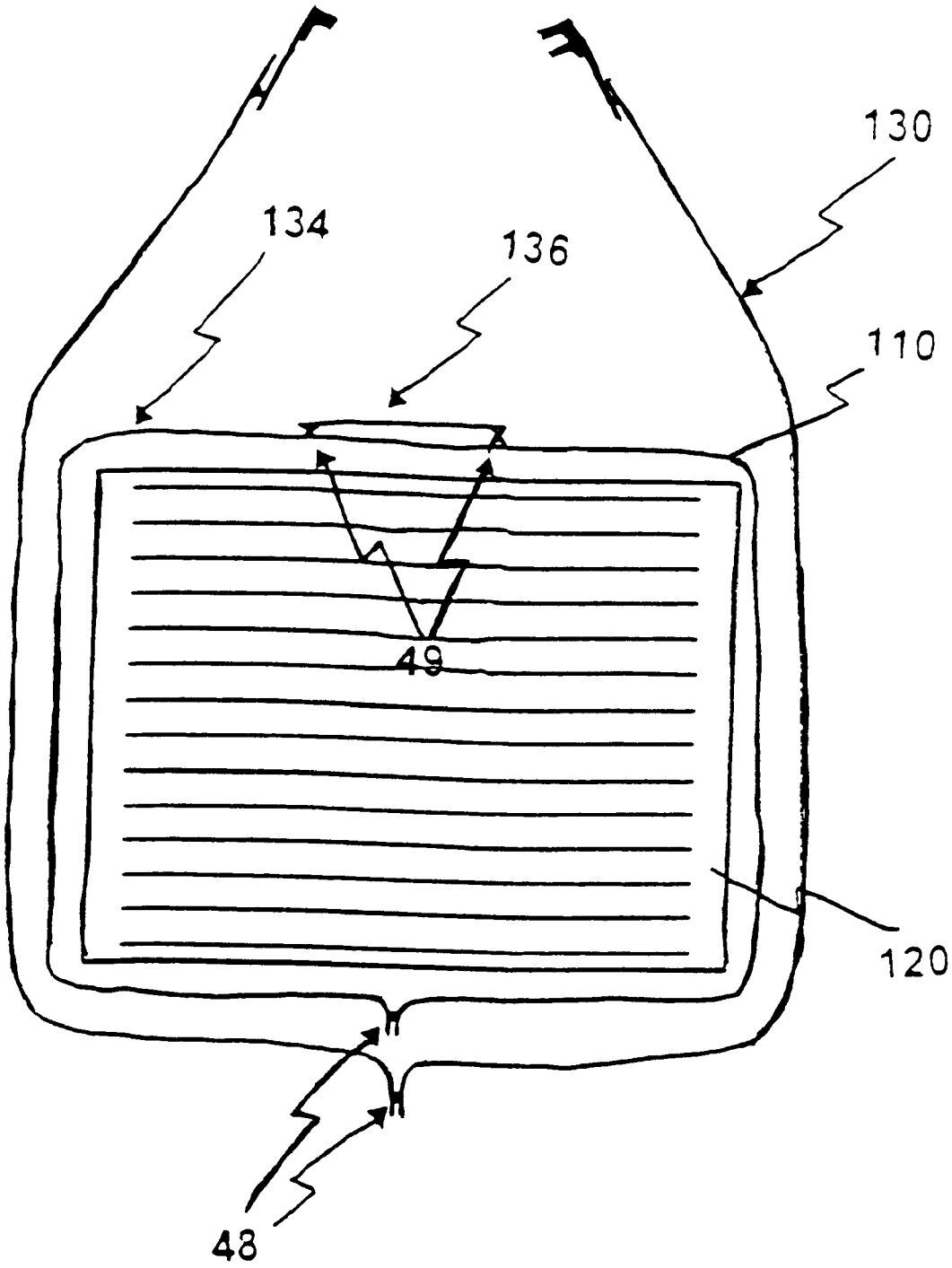
Figure 23:
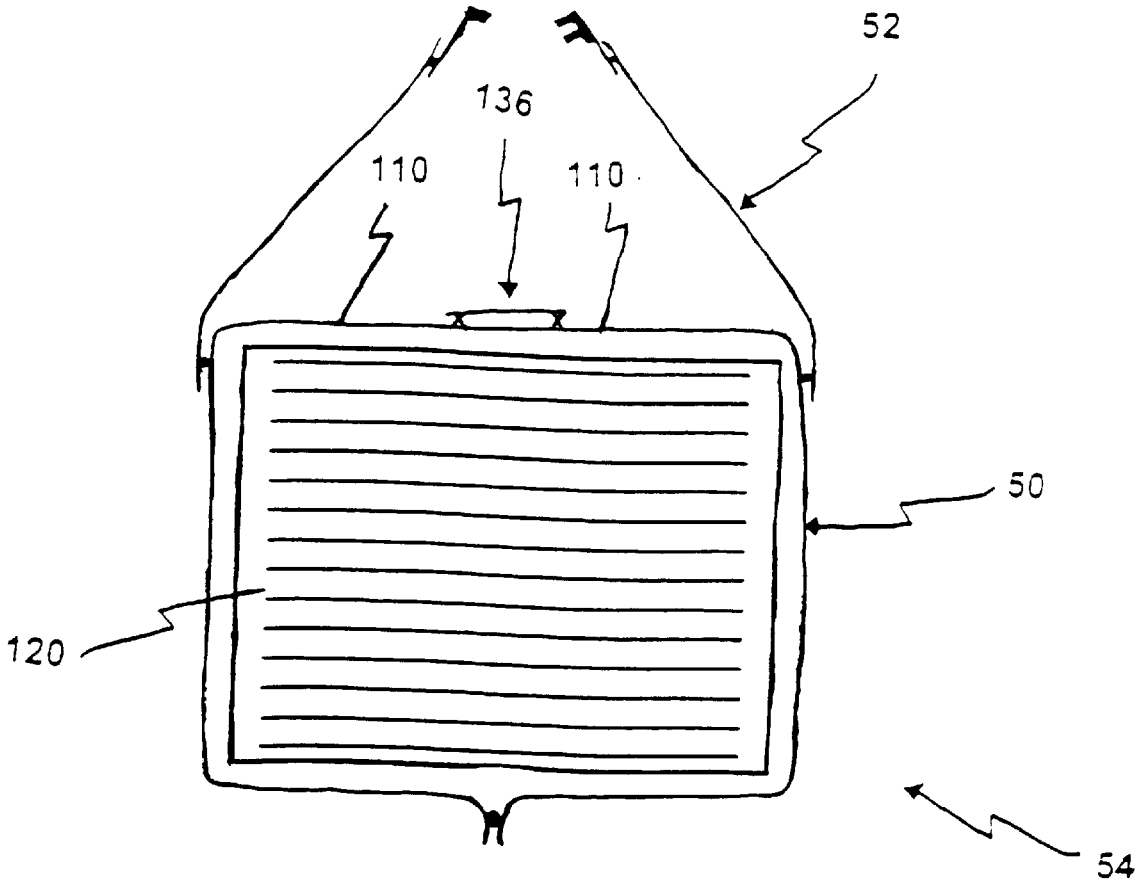
Figure 24:
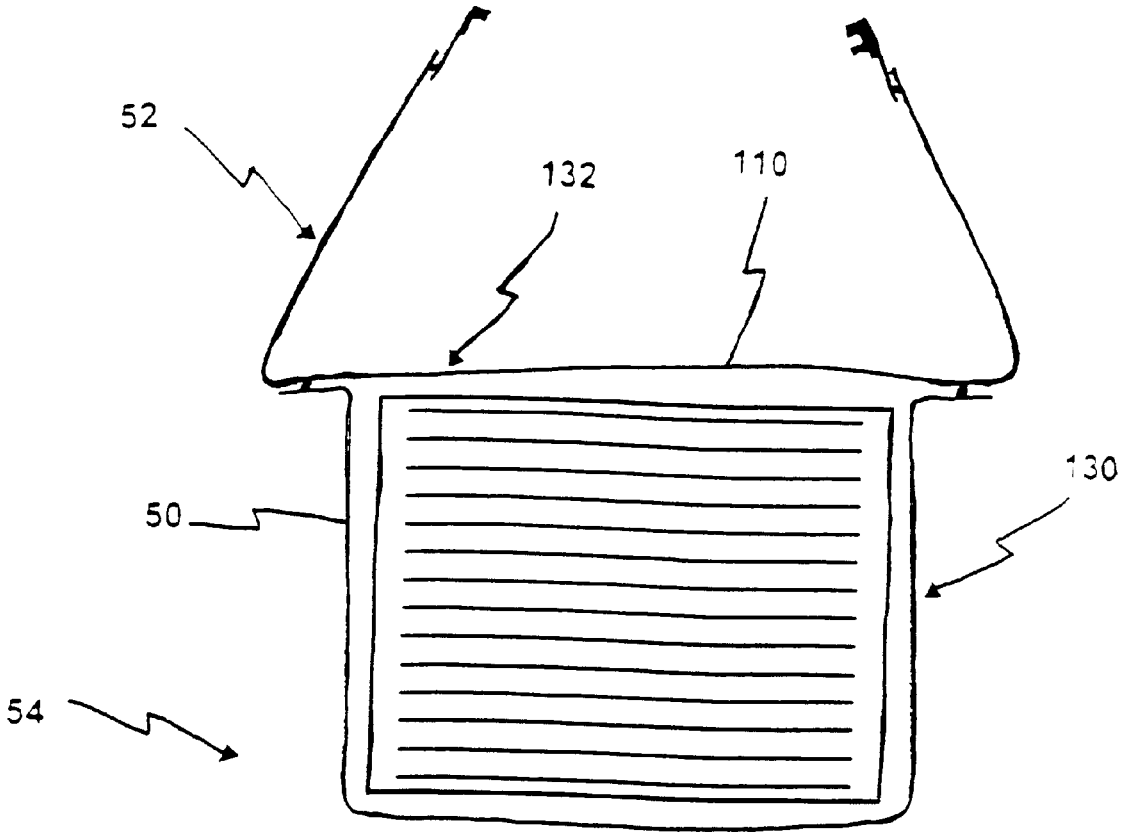

The "joining" of various package components, e.g., baffle structure 110, container 30, sides 50 resealable mechanism 100, can be by various mechanical and chemical methods known in the art, including, but not limited to, use of glue or other bonding material, thermal bonding or welding, ultrasonic bonding or welding, or other joining methods as long as they create a permanent joined relationship between components as opposed to a resealable relationship therebetween. As seen throughout the FIGS. and defined in FIG. 14, a first piece or portion of package material 46 is representatively joined by any of the just-mentioned methods to a second piece or portion of package material at a material attachment location 48. Attachment location 48 generally represents a linear attachment zone, though it could be any method adequate to form a seal between two opposing layers of material 46 to separate an environment on one side of the material from an environment on a different side of the material. Referring to FIGS. 22 and 23 the package material can be a resealable label 136 that is joined to the baffle structure 110 by a resealable adhesive 49 represented by an "x" in the drawings.

Figure 9:
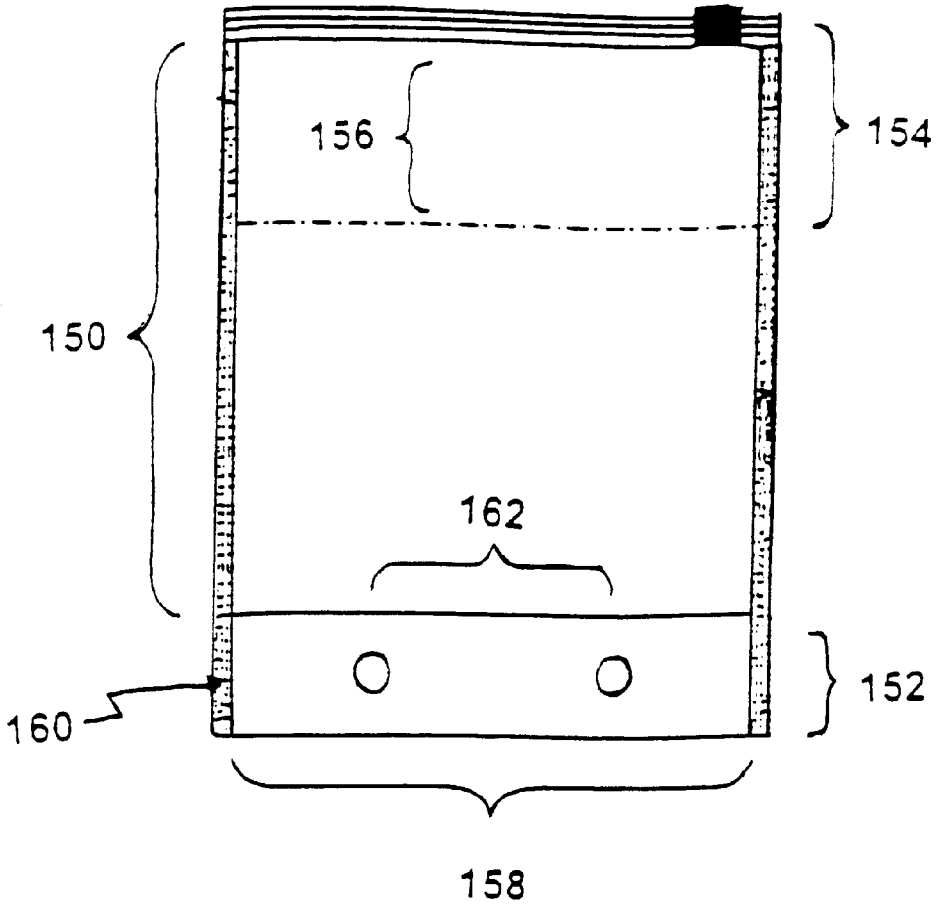
FIG. 9 representatively shows a front plan view of the package for wipes illustrated in FIG. 5.
Figure 10:
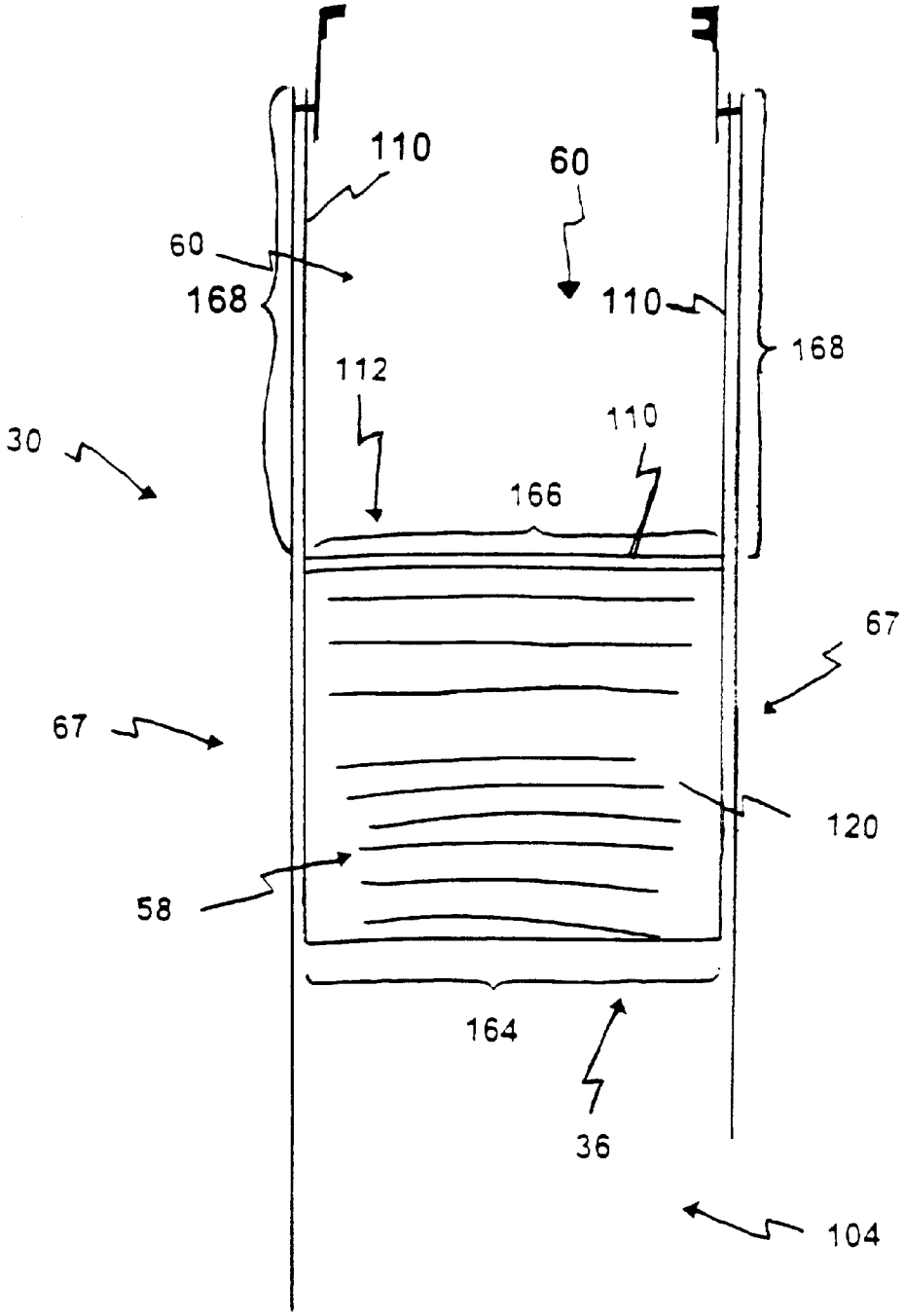
FIG. 10 representatively shows a cross-sectional view of another example of a package for wipes according to the present invention before dispensing any wipes and in an open position prior to completed assembly and with wipes inside the package.
Figure 11:
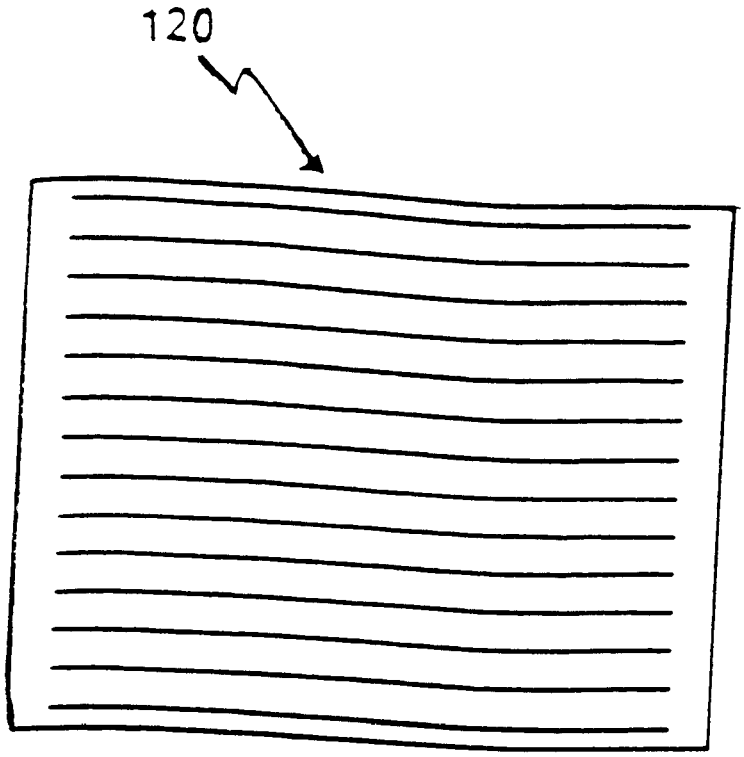
FIG. 11 representatively shows a cross-sectional view of a stack of wipes for use in the present invention.

The container 30 can have a wicket flap 62 with wicket holes 64 to assist in the wipes filling process. Once the container is formed as seen in FIGS. 5 to 9, then wipes can be placed inside (FIG. 10). Thereafter the sides forming the bottom end portion 54 are sealed together to seal closed the bottom end portion, and the resealable mechanism 100 is also sealed closed, if it is not already so upon joining with the sides 50 (FIG. 3). The package 30 is now completely formed and ready for use by a user (not shown). In use, the resealable mechanism 100 is opened and then access to the dispensing portion 60 is gained. The user then passes his or her hand, etc. through the orifice 80 to grab the first wipe in the stack of wipes 120. If the orifice is a frangible seal 82, this must be broken before the user can pass his or her hand through the orifice. Once the user grabs the wipe, it can then pass through the orifice and enter the dispensing portion 60 as the user pulls it up. If the user does not immediately need the wipe, it can be left in the orifice partially dispensed where it can be maintained in place by the baffle structure 110 until desired later. The resealable mechanism may be sealed closed if no further wipes are desired in order to best maintain the hygiene and/or moisture level of the wipes. The partially dispensed wipe will just rest in place in the orifice, part in the dispensing portion and part in the storage portion, conveniently ready for later dispensing. If the user does immediately desire to use the wipe, it can pass the complete wipe through the dispensing portion and out of the package. Depending on the configuration of the stack (FIG. 11) or roll (FIG. 12) of wipes 120, discussed further below, the next wipe for dispensing may be automatically maintained in the orifice partially dispensed for later use (i.e., a popup dispensing format) or it may need to be fetched out of the storage portion similar to the first wipe at a later time when it is desired. In either case, after the desired number of wipes are taken, the resealable mechanism can be sealed closed, with or without a wipe partially dispensed in the dispensing portion, as discussed previously.

The package of the present invention can be made from various materials and in various configurations. By way of example without limitation, reference is made to FIGS. 9 and 10 for some of these. The container 30 can be made of about 12 um polyester film laminated to about 50 um polyethylene film. The polyester film can be reverse printed, so the printing is between the two film layers. Alternatively, a single-ply surface printed film can be used. A single-ply film can be composed of one or more layers of polyolefin, and, e.g., formed in a coextrusion. The baffle structure 110 can be about 50 um polyethylene film, printed or unprinted. Alternatively, the structure 110 could be a polypropylene film. The baffle structure 110 may be about 317 mm by about 200 mm in size. It can then be folded in half and joined with the container sides, e.g., in the side seams joining sides 66. If the top portions 117 of the baffle are also joined with opposing sides 67 of the container, they can be joined about 15 mm beneath the top of the resealable mechanism 100. The baffle structure 110 can have installed dimensions of two times 168 at about 60 mm each and 166 at about 110 mm for a total baffle width of about 230 mm, and where the container width 164 can be about 110 mm. Referring to FIG. 9, a flattened package 20 without wipes therein may have the following dimensions: 150 for inside height of about 273 mm; 152 for wicket flap of about 42 mm; 154 for top of resealable mechanism to bottom of baffle structure of about 115 mm; 156 for baffle structure top attachment location to bottom of baffle structure of about 100 mm; 158 for inside width of about 305 mm; 160 for weld thickness of about 6 mm for two joined material layers.

The wipes, e.g., wet wipes, can be arranged in the package 20 in any manner which provides convenient and reliable one at a time dispensing and which assists the wet wipes in not becoming overly dry. For example, the wet wipes (FIG. 11) can be arranged in the package 20 as a plurality of individual sheets arranged in a stacked configuration to provide a stack of wet wipes which may or may not be individually folded. The wet wipes can be individual wet wipes which are folded in a c-fold or z-fold configuration as are known to those skilled in the art and then stacked on top of each other to provide the stack of wet wipes. Alternatively, if the wet wipes are to be arranged in a stacked configuration in the package 20, the individual wet wipes can be interfolded such that the leading and trailing end edges of successive wipes in the stacked configuration overlap. In such a configuration, the leading end edge of the trailing wet wipe is loosened from the stack by the trailing end edge of the leading wet wipe as the leading wet wipe is removed by the user. The wet wipes can be interfolded to facilitate such dispensing by means known to those skilled in the art.

Figure 37:
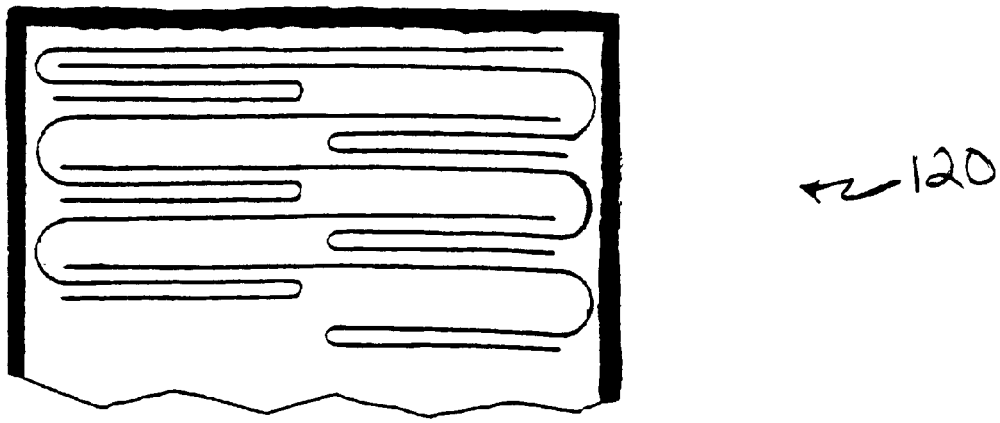
FIG. 37 representatively shows a cross-sectional view of an interfolded stack of wipes for use in the present invention.
Figure 38:
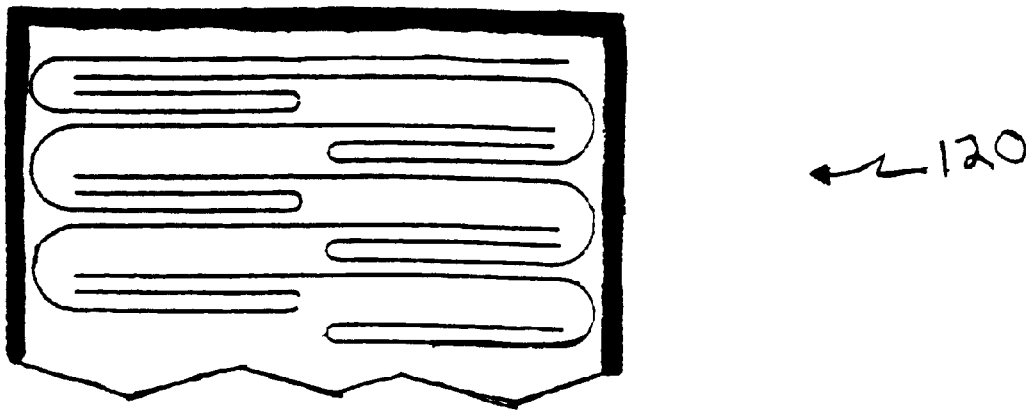
FIG. 38 representatively shows a cross-sectional view of an alternate interfolded stack of wipes for use in the present invention.

One example of such well known interfolded means is set forth in U.S. Pat. No. 5,497,903, issued Mar. 12, 1996, of inventor Katsu Yoneyama, the disclosure of which is incorporated fully herein by reference. FIGS. 37 and 38 representatively show a cross-sectional view of an interfolded stack of wipes for use in the present invention.

Figure 12:
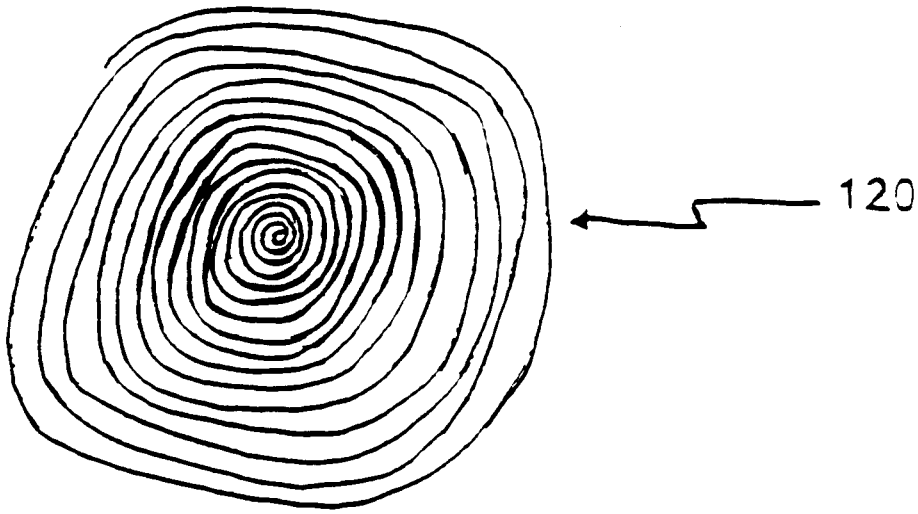
FIG. 12 representatively shows a cross-sectional view of a roll of wipes for use in the present invention.
Figure 39:
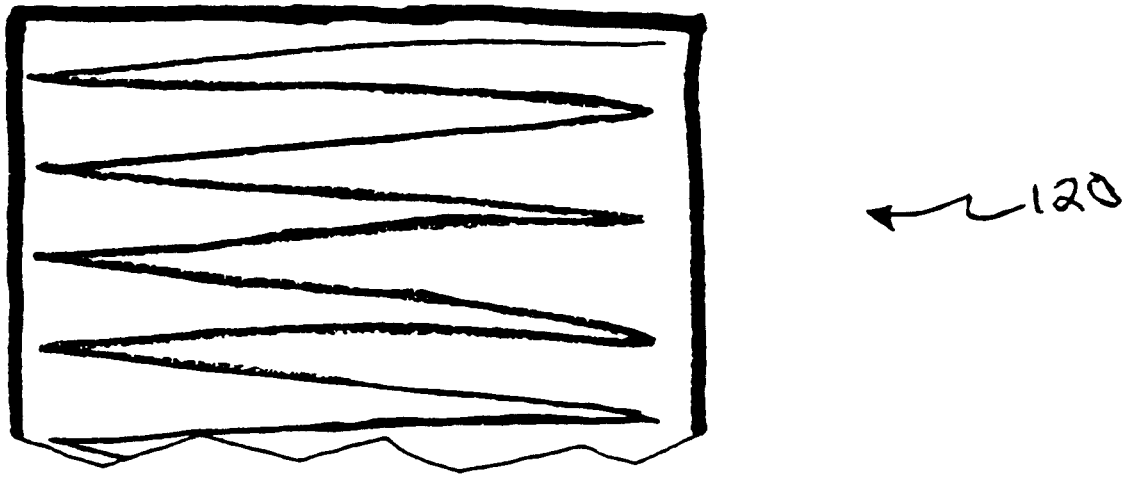
FIG. 39 representatively shows a cross-sectional view of an accordion-like stack of wipes for use in the present invention.

Alternatively, the wet wipes can be arranged in the package 20 as a continuous web of interconnected wet wipes which are folded in an accordion-like stacked configuration (FIG. 39) or a roll (FIG. 12). The individual wet wipes can be connected together along lines of frangibility, such as lines of perforations, to ensure that the trailing wet wipe is in position for grasping by the user after the leading wet wipe is removed. For example, the wet wipes can be provided by a continuous web of material which has a series of lines of frangibility extending across the width of the web. The portion of the web of material between successive lines of frangibility provides each individual wet wipe. The lines of frangibility can be provided by means known to those skilled in the art such as perforations, indentations or cuts in the web of material. For example, the lines of frangibility or perforations can be provided in the web of material by passing the web of material between a die cutter roll and anvil roll. After the lines of frangibility have been incorporated into the web of material, the web can then be arranged in a stacked configuration for easy insertion into the storage portion 58 of the package 20.

The package 20 of the present invention can include any suitable number of individual wet wipes depending upon the desired packaging and end use. For example, the package 20 can be configured to include a stack of wet wipes which can include at least about 5 wet wipes and desirably from about 16 to about 320 individually wet wipes, and more desirably from about 32 to about 160 wet wipes. The size and shape of the stack of wipes 120 is dependent upon the size and shape of the package 20 and vice versa. For example, the length 124 of the assembled stack of wipes can be about 190 mm, with a height of about 90 mm and a width of about 110 mm.

Each wet wipe is generally rectangular in shape and defines a pair of opposite side edges and a pair of opposite end edges which can be referred to as a leading end edge and a trailing end edge. The leading end edge of each wet wipe is typically positioned in the package 20 to be grasped by a user to facilitate a removal of the wet wipe from the package 20. Each wet wipe defines an unfolded width and an unfolded length. The wet wipe can have any suitable unfolded width and length. For example, the wet wipe can have an unfolded length of from about 2.0 to about 80.0 centimeters and desirably from about 10.0 to about 26.0 centimeters and an unfolded width of from about 2.0 to about 80.0 centimeters and desirably from about 10.0 to about 45.0 centimeters.

Materials suitable for the wet wipes of the present invention are well known to those skilled in the art. The wet wipes can be made from any material suitable for use as a moist wipe, including meltblown, coform, air-laid, bonded-carded web materials, hydroentangled materials, high wet-strength tissue and the like and can comprise synthetic or natural fibers or combinations thereof. The wet wipes can have a basis weight of from about 25 to about 120 grams per square meter and desirably from about 40 to about 90 grams per square meter.

In a particular aspect, the wet wipes can comprise a coform basesheet of polymeric microfibers and cellulosic fibers having a basis weight of from about 60 to about 100 grams per square meter and desirably about 80–85 grams per square meter. Such coform basesheets are manufactured generally as described in U.S. Pat. No. 4,100,324 to Anderson et al. which issued Jul. 11, 1978, and which is herein incorporated by reference. More particularly, such coform basesheets can be manufactured as described in recently filed U.S. Patent application Ser. No. 09/751329, filed on Dec. 29, 2000 entitled,"Composite Material With Cloth-like Feel" of inventors Scott R. Lange et al. under Express Mail Label EL637139256US and Atty. No. 1443.001US1, and which is incorporated herein by reference. Typically, such coform basesheets comprise a gas-formed matrix of thermoplastic polymeric meltblown microfibers, such as, for example, polypropylene microfibers, and cellulosic fibers, such as, for example, wood pulp fibers. The relative percentages of the polymeric microfibers and cellulosic fibers in the coform basesheet can vary over a wide range depending on the desired characteristics of the wet wipes. For example, the coform basesheet can comprise from about 20 to about 100 weight percent, desirably from about 20 to about 60 weight percent, and more desirably from about 30 to about 40 weight percent of polymeric microfibers based on the dry weight of the coform basesheet being used to provide the wet wipes.

The wipes of the different aspects of the present invention can contain a liquid which can be any solution which can be absorbed into the wipes, thus making them "wet wipes." The liquid contained within the wet wipes can include any suitable components which provide the desired wiping properties. For example, the components can include water, emollients, surfactants, preservatives, chelating agents, pH buffers, fragrances or combinations thereof. The liquid can also contain lotions, ointments and/or medicaments.

The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 200 to about 400 weight percent liquid based on the dry weight of the wipe for improved wiping. In a particular aspect wherein the wet wipe is made from a coform material comprising from about 30 to about 40 weight percent polymeric microfibers based on the dry weight of the wipe, the amount of liquid contained within the wet wipe is from about 250 to about 350 weight percent and desirably about 330 weight percent based on the dry weight of the wet wipe. If the amount of liquid is less than the above-identified range, the wet wipes can be too dry and can not adequately perform. If the amount of liquid is greater than the above-identified range, the wet wipes can be over saturated and soggy and the liquid can pool in the bottom of the container.

One or the other of the container 30 and the baffle structure 110 of the packages 20 of the invention can be transparent, translucent or opaque. There are certain features associated with either of the container or the baffle structure being transparent or translucent. For example, when the container 30 is transparent, the user of the package 20 can readily determine the quantity of wet wipes remaining in the package. That is, the user can determine the quantity of wet wipes remaining in the package 20 without having to open the resealable mechanism 100 of the package.

Aesthetic and functional features are also obtained when one or the other of the container 30 or baffle structure 110 are colored. For example, differently colored containers can be used to distinguish the packaging for different types of wet wipe products. Similarly, aesthetic and functional features can be achieved when the container 30 or the baffle structure 110 have graphics printed on them. In addition to aesthetic benefits, the graphics can be used to distinguish between various wet wipe product types.

Accordingly, the different aspects and features of the present invention can provide containers for wipes which, when compared to conventional containers for wipes, provide improved same container storage and dispensing. Such containers are particularly useful for dispensing baby wipes since the caregiver typically only has one hand free during the diapering process. Thus, the packages for wipes, e.g., wet wipes, of the present invention are reliably and easily opened by one hand of the user or care giver for improved convenience and personal hygiene. Additionally, the packages of the invention can self-maintain an open position of and provide better easier wipe dispensing.

While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims.

What is claimed is:

1. A storage and dispensing package for wipes comprising: a non-rigid container comprising sides with a top end portion and a bottom end portion, where the sides and top and bottom end portions define a cavity within the container;

the cavity including a storage portion for wipes;

the top end portion including a resealable mechanism;

a non-rigid baffle structure having a width and located in between the resealable mechanism and the storage portion with the baffle structure positioned between opposing sides of the container spaced apart from each other, the baffle structure thereby defining a dispensing portion of the cavity overlying the storage portion of the cavity wherein at least two opposite sides of the baffle structure are joined to respective opposing sides of the container spaced apart from each other and thereby the baffle structure spans between the opposing sides of the container; and, the baffle structure including a dispensing orifice through which wipes can pass and communicate with the dispensing portion.

2. The package of claim 1 wherein all opposite sides of the baffle structure are joined to respective opposing sides of the container and thereby the baffle structure spans between the opposing sides of the container and completely separates the storage portion of the cavity from the dispensing portion of the cavity except at the dispensing orifice.

3. The package of claim 1 wherein all opposite sides of the baffle structure are joined to respective opposing sides of the container and thereby the baffle structure spans between the opposing sides of the container and completely separates the storage portion of the cavity from the dispensing portion of the cavity.

4. The package of claim 1 wherein the resealable mechanism is sealed closed and the bottom end portion is open.

5. The package of claim 4 wherein wipes are positioned within the storage portion of the cavity and the bottom end portion is sealed closed.

6. The package of claim 1 wherein wipes are positioned within the storage portion of the cavity and the bottom end portion is sealed closed.

7. The package of claim 1 wherein the container is formed from a first piece of material and the baffle structure is formed from a second piece of material separate from the first piece of material.

8. The package of claim 1 wherein the container and the baffle structure are formed from one continuous piece of material.

9. The package of claim 5 wherein a center area portion of the baffle structure is oriented substantially parallel to an adjacent surface area of the wipes which are positioned within the storage portion of the cavity.

10. The package of claim 6 wherein a center area portion of the baffle structure is oriented substantially parallel to an adjacent surface area of the wipes which are positioned within the storage portion of the cavity.

11. The package of claim 1 wherein the dispensing orifice comprises a frangible seal.

12. The package of claim 11 wherein the frangible seal is closed until opened for the first time by a user of the package.

13. The package of claim 1 wherein the baffle structure is joined to the container for little or no movement relative to the container in a longitudinal direction of the container.

14. The package of claim 5 wherein the baffle structure is configured such that a center area portion of the baffle structure rests on an adjacent surface area of the wipes which are positioned within the storage portion of the cavity.

15. The package of claim 6 wherein the baffle structure is configured such that a center area portion of the baffle structure rests on an adjacent surface area of the wipes which are positioned within the storage portion of the cavity.

16. The package of claim 1 wherein the dispensing portion is sized and configured to loosely retain a personal item in between the baffle structure and the resealable mechanism when the resealable mechanism is sealed closed.

17. The package of claim 1 wherein the dispensing portion can expand to have a triangular shaped cross-sectional dimension when defined by an imaginary plane passing through the top and bottom end portions and through a width of the container and wherein a base of the triangular shaped cross-sectional dimension of the dispensing portion is adjacent the baffle structure and an apex of the triangular shaped cross-sectional dimension is spaced from the baffle structure.

18. The package of claim 1 wherein the width of the baffle structure is at least as great as a width of the container.

19. The package of claim 18 wherein the width of the baffle structure is at least 1.5 times as great as the width of the container.

20. The package of claim 19 wherein the width of the baffle structure is at least 2 times as great as the width of the container and not more than 3 times as great as the width of the container.

21. The package of claim 5 wherein the wipes comprise wet wipes.

22. The package of claim 6 wherein the wipes comprise wet wipes.

23. The package of claim 1 wherein the dispensing orifice comprises a member from the group comprising a hole, a slit and a combination of a hole and a slit.

24. The package of claim 1 wherein the dispensing orifice comprises anti-tear end portions disposed adjacent the orifice.

25. The package of claim 1 wherein the dispensing orifice is oriented so a longitudinal dimension of the orifice is positioned comprising a member from the group comprising approximately parallel with a length of the wipes, approximately perpendicular with a length of the wipes and approximately diagonally with a length of the wipes.

26. The package of claim 1 wherein the dispensing orifice is located relative to a longitudinal axis of the container at a position comprising a member from the group comprising a center portion of the container, an end portion of the container and between an end portion of the container and a center portion of the container.

27. A storage and dispensing package for wipes comprising:

a non-rigid container having sides which define a cavity therein and including a resealable mechanism located adjacent a top portion of the sides;

a collapsible-expandable baffle structure having a width and positioned within the sides of the container and dividing the cavity into a storage portion for wipes and a dispensing portion wherein at least two opposite sides of the baffle structure are joined to respective opposing sides of the container spaced apart from each other and thereby the baffle structure spans between the opposing sides of the container; and, the baffle structure including a dispensing orifice through which wipes can pass and communicate with the dispensing portion.

28. The package of claim 27 further comprising a resealable mechanism, the resealable mechanism adjoining at least two sides of the container.

29. The package of claim 27 wherein all opposite sides of the baffle structure are joined to respective opposing sides of the container and thereby the baffle structure spans between the opposing sides of the container and completely separates the storage portion of the cavity from the dispensing portion of the cavity except at the dispensing orifice.

30. The package of claim 27 wherein all opposite sides of the baffle structure are joined to respective opposing sides of the container and thereby the baffle structure spans between the opposing sides of the container and completely separates the storage portion of the cavity from the dispensing portion of the cavity.

31. The package of claim 28 wherein the resealable mechanism is sealed closed and a bottom end portion of the container is open.

32. The package of claim 31 wherein wipes are positioned within the storage portion of the cavity and the bottom end portion is sealed closed.

33. The package of claim 27 wherein wipes are positioned within the storage portion of the cavity and a bottom end portion of the container is sealed closed.

34. The package of claim 27 wherein the storage portion is at least partially enclosed by a first piece of material and the dispensing portion is at least partially enclosed by a second piece of material separate from the first piece of material.

35. The package of claim 27 wherein the container and the baffle structure are formed from one continuous piece of material.

36. The package of claim 32 wherein a center area portion of the baffle structure is oriented substantially parallel to an adjacent surface area of the wipes which are positioned within the storage portion of the cavity.

37. The package of claim 33 wherein a center area portion of the baffle structure is oriented substantially parallel to an adjacent surface area of the wipes which are positioned within the storage portion of the cavity.

38. The package of claim 27 wherein the dispensing orifice comprises a frangible seal.

39. The package of claim 38 wherein the frangible seal is closed until opened for the first time by a user of the package.

40. The package of claim 27 wherein the baffle structure is joined to the container for little or no movement relative to the container in a longitudinal direction of the container.

41. The package of claim 32 wherein the baffle structure is configured such that a center area portion of the baffle structure rests on an adjacent surface area of the wipes which are positioned within the storage portion of the cavity.

42. The package of claim 33 wherein the baffle structure is configured such that a center area portion of the baffle structure rests on an adjacent surface area of the wipes which are positioned within the storage portion of the cavity.

43. The package of claim 27 wherein the dispensing portion is sized and configured to loosely retain a personal item therein when the resealable mechanism is sealed closed.

44. The package of claim 27 wherein the dispensing portion can expand to have a triangular shaped cross-sectional dimension when defined by an imaginary plane passing through a width of the container and wherein a base of the triangular shaped cross-sectional dimension of the dispensing portion is adjacent the baffle structure and an apex of the triangular shaped cross-sectional dimension is spaced from the baffle structure.

45. The package of claim 27 wherein the width of the baffle structure is at least as great as a width of the container.

46. The package of claim 45 wherein the width of the baffle structure is at least 1.5 times as great as the width of the container.

47. The package of claim 46 wherein the width of the baffle structure is at least 2 times as great as the width of the container and not more than 3 times as great as the width of the container.

48. The package of claim 32 wherein the wipes comprise wet wipes.

49. The package of claim 33 wherein the wipes comprise wet wipes.

50. The package of claim 27 wherein the dispensing orifice comprises a member from the group comprising a hole, a slit and a combination of a hole and a slit.

51. The package of claim 27 wherein the dispensing orifice comprises anti-tear end portions disposed adjacent the orifice.

52. The package of claim 27 wherein the dispensing orifice is oriented so a longitudinal dimension of the orifice is positioned comprising a member from the group comprising approximately parallel with a length of the wipes, approximately perpendicular with a length of the wipes and approximately diagonally with a length of the wipes.

53. The package of claim 27 wherein the dispensing orifice is located relative to a longitudinal axis of the container at a position comprising a member from the group comprising a center portion of the container, an end portion of the container and between an end portion of the container and a center portion of the container.

54. The package of claim 1 wherein the resealable mechanism comprises a resealable track and a slider for sealing and unsealing the track.

55. The package of claim 27 wherein the resealable mechanism comprises a resealable track and a slider for sealing and unsealing the track.

56. A package for storing and popup dispensing of wipes comprising:

a non-rigid container having opposing sides which define a cavity within the container;

means for (a) dividing the cavity, into a storage portion for wipes and a dispensing portion overlying the storage portion and (b) adjustably separating opposing sides of the container where the opposing sides are adjacent the means for dividing;

a plurality of wipes are located in the storage portion;

means for (a) dispensing the wipes through the means for dividing and out of the container in a first mode and (b) dispensing at least one of the plurality of wipes through the means for dividing and retaining a first portion of the at least one wipe within the storage portion and a second portion of the at least one wipe within the dispensing portion for later use while also enabling the container to be sealed closed in a second mode; and, wherein the means for dividing and adjustably separating comprises a baffle structure and at least two opposite sides of the baffle structure are joined to respective opposing sides of the container spaced apart from each other and thereby the baffle structure spans between the opposing sides of the container.

57. The package of claim 21 wherein the wet wipes are configured as a member from the group consisting of folded stack, interfolded stack, accordion-like stack and roll.

58. The package of claim 22 wherein the wet wipes are configured as a member from the group consisting of folded stack, interfolded stack, accordion-like stack and roll.

59. The package of claim 48 wherein the wet wipes are configured as a member from the group consisting of folded stack, interfolded stack, accordion-like stack and roll.

60. The package of claim 49 wherein the wet wipes are configured as a member from the group consisting of folded stack, interfolded stack, accordion-like stack and roll.

* * * * *